US008092256B2

(12) United States Patent
Takao

(10) Patent No.: US 8,092,256 B2
(45) Date of Patent: Jan. 10, 2012

(54) CARD CONNECTOR ASSEMBLY AND ELECTRONIC APPARATUS

(75) Inventor: Kazuaki Takao, Kawasaki (JP)

(73) Assignee: Fujitsu Limited, Kawasaki (JP)

( * ) Notice: Subject to any disclaimer, the term of this patent is extended or adjusted under 35 U.S.C. 154(b) by 0 days.

(21) Appl. No.: 13/005,917

(22) Filed: Jan. 13, 2011

(65) Prior Publication Data

US 2011/0177698 A1 Jul. 21, 2011

(30) Foreign Application Priority Data

Jan. 15, 2010 (JP) ..... 2010-007304

(51) Int. Cl.
*H01R 24/00* (2011.01)

(52) U.S. Cl. ..... 439/630; 439/159; 439/55

(58) Field of Classification Search ..... 439/569–573
See application file for complete search history.

(56) References Cited

U.S. PATENT DOCUMENTS 4,295,705 A * 10/1981 Ciliberti, Jr. ..... 439/389
5,579,204 A * 11/1996 Nelson et al. ..... 361/679.32
6,146,150 A * 11/2000 Roberts ..... 439/55
6,231,382 B1 * 5/2001 Yu ..... 439/541.5
6,478,617 B2 * 11/2002 Fan ..... 439/570
6,722,921 B1 * 4/2004 Yu ..... 439/573
7,014,506 B2 * 3/2006 Ho et al. ..... 439/607.22
7,037,123 B2 * 5/2006 Nakamura et al. ..... 439/152
2001/0018292 A1 * 8/2001 Shimoyama et al. ..... 439/573
2003/0139093 A1 * 7/2003 Zhang ..... 439/571
2004/0102087 A1 * 5/2004 Berens et al. ..... 439/534
2006/0046567 A1 * 3/2006 Ho et al. ..... 439/607
2009/0093141 A1 * 4/2009 Ting ..... 439/65

FOREIGN PATENT DOCUMENTS

JP 2501523 Y2 6/1996
JP 2007-227078 A 9/2007
JP 2001-196112 A 7/2011

* cited by examiner

*Primary Examiner* — Briggitte R Hammond
(74) *Attorney, Agent, or Firm* — Squire, Sanders & Dempsey (US) LLP

(57) ABSTRACT

A card connector assembly includes a substrate, a card connector, and a stud member. The card connector is mounted on the substrate, and includes a pin member which has a neck section and an engagement section coupled to the tip side of the neck. The stud member is provided on the substrate, and has an elastic insert section through which the neck section of the pin member is inserted. The neck section of the pin member is configured to have a floating structure with the stud member.

2 Claims, 27 Drawing Sheets

CARD CONNECTOR ASSEMBLY AND ELECTRONIC APPARATUS

CROSS-REFERENCE TO RELATED APPLICATION

This application is based upon and claims the benefit of priority of the prior Japanese Patent Application No. 2010-7304, filed on Jan. 15, 2010, the entire contents of which are incorporated herein by reference.

FIELD

Embodiments discussed herein are related to a card connector assembly and an electronic apparatus incorporating the card connector assembly therein.

BACKGROUND

Various peripheral interface cards such as the PCMCIA card (also known as an IC card, PC card or Card Bus) and the Express Card are known. Conventionally, the peripheral interface cards are plug-in types, and are connected to an electronic apparatus such as a personal computer (PC) via a card slot. A Local Area Network (LAN) card designed for wireless communication is also available. The cards may enhance the function of storage expansion and/or a network of the PC. Typically, the Integrated Circuit (IC) chip is mounted in the card, and thus data reading and/or data writing may be executed.

The inserted card is coupled to a connector section on a substrate. A card connector is provided on the substrate placed inside the electronic apparatus to couple a card to the connector section. The card connector is provided with a card-eject button.

For example, a card connector assembly to mount the card connector on a substrate is discussed in Japanese Patent Application Laid-open Publication No. 2007-227078, and a slide guide-mounting device for an IC card is discussed in Japanese Utility Model Application Laid-open Publication No. 3-41361.

A card connector (i.e., guide mechanism) is mounted on a substrate, and the substrate is housed in the enclosure corresponding to an outer covering of an electronic apparatus. A card-eject button, which is provided in the card connector, comes to be exposed from the enclosure through an opening. On the other hand, soldering or thread-mounting is often used to affix the card connector to the substrate. However, connection looseness between the card connector and the substrate and/or positioning tolerance of other components may lead to a positioning misalignment of the card connector. Depending on the positioning misalignment, the card-eject button may undesirably interfere with the enclosure, which leads to poor operation in ejecting the card from the PC. The defective card slot is fixed on the assembly line so as to eliminate the interference between the card-eject button and the enclosure, and is then shipped out.

The card connector discussed in JP-A-2007-227078 and the sliding guide mechanism discussed in JP-U-3-41361 do not give particular consideration with respect to the avoidance of interference between the enclosure of the electronic device and the card-eject button.

SUMMARY

According to an embodiment of the invention, a card connector assembly includes a substrate, a card connector, and a stud member. The card connector is mounted on the substrate, and includes a pin member which has a neck section and an engagement section coupled to the tip side of the neck. The stud member is provided on the substrate, and has an elastic insert section through which the neck section of the pin member is inserted. The neck section of the pin member is configured to have a floating structure with the stud member.

It is to be understood that both the foregoing general description and the following detailed description are exemplary and explanatory, and are not restrictive of the invention.

BRIEF DESCRIPTION OF DRAWINGS

FIG. 12A is a top view of the state, and FIG. 12B is a side view of the state;

FIG. 13A is a top view of the state, and FIG. 13B is a side view of the state;

FIG. 14A is a top view of the state, and FIG. 14B is a side view of the state;

FIG. 15A is a top view of the state, and FIG. 15B is a side view of the state;

FIG. 16A is a top view of the stud member, and FIG. 16B is a side view of the stud member;

DESCRIPTION OF EMBODIMENTS

Figure 1:
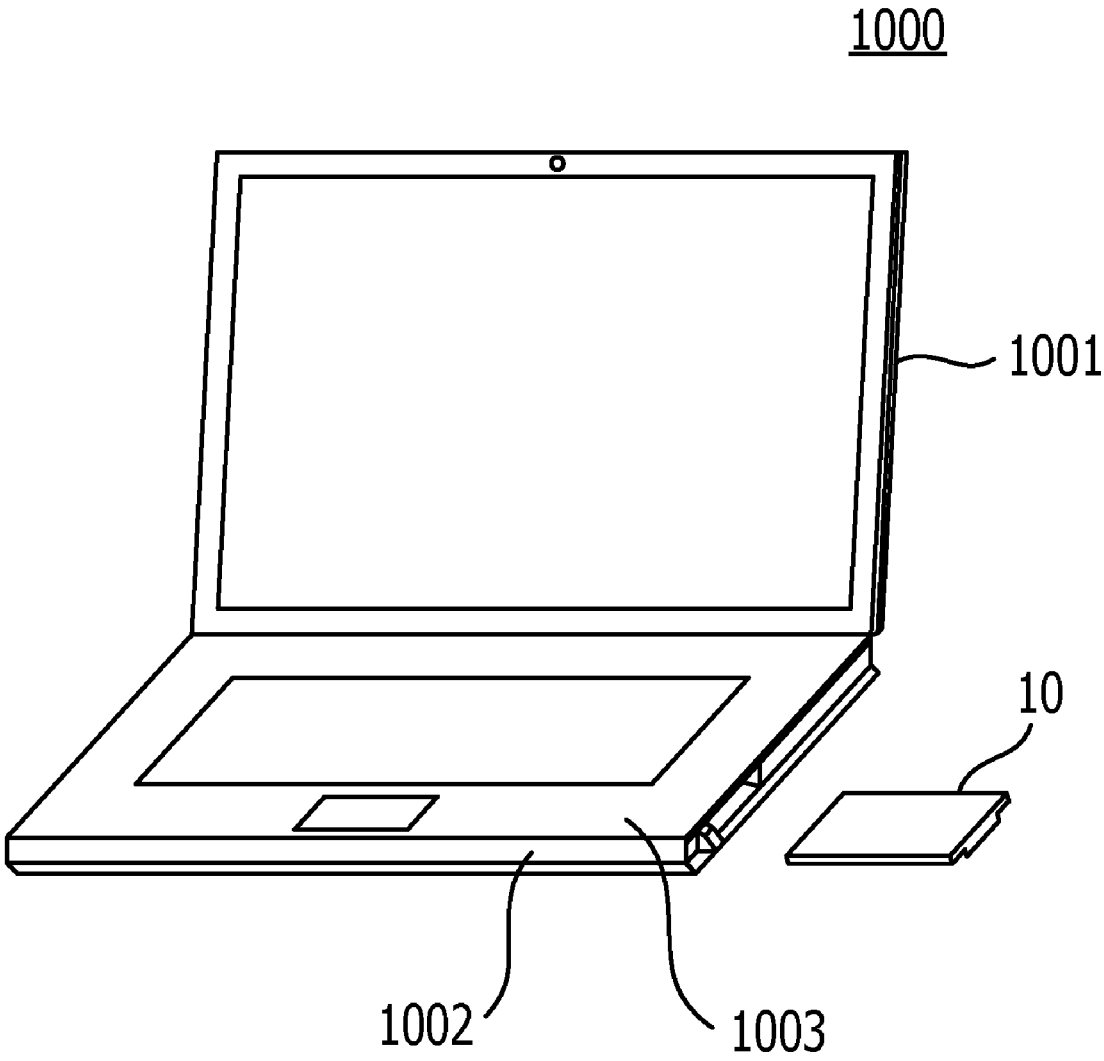
FIG. 1 is a perspective view of a personal computer.

Embodiments are discussed below with reference to attached drawings. However, dimensions, proportions, and the like of respective parts may not be illustrated so that the dimensions, the proportions, and the like of respective parts correctly reflect the actual card connector assembly in the drawings. Moreover, there may be cases where details of the respective parts are omitted in the drawings.

Figure 2:
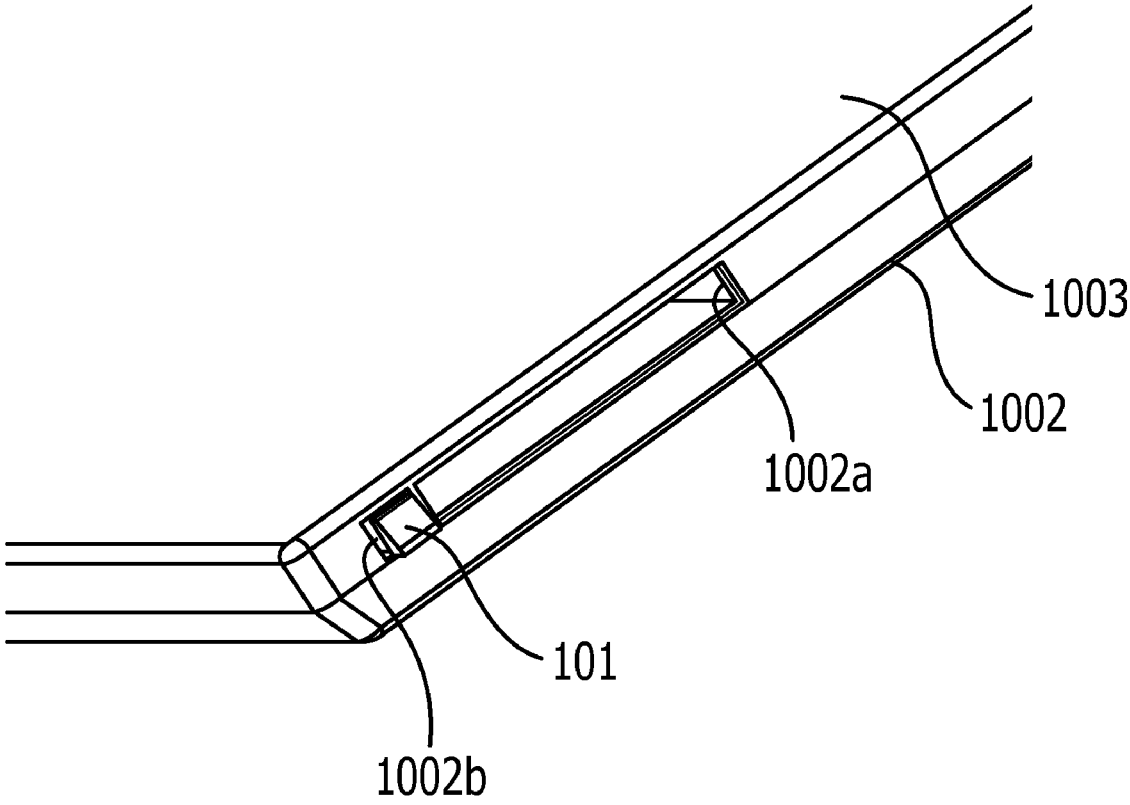
FIG. 2 illustrates a slot for card insertion.
Figure 6:
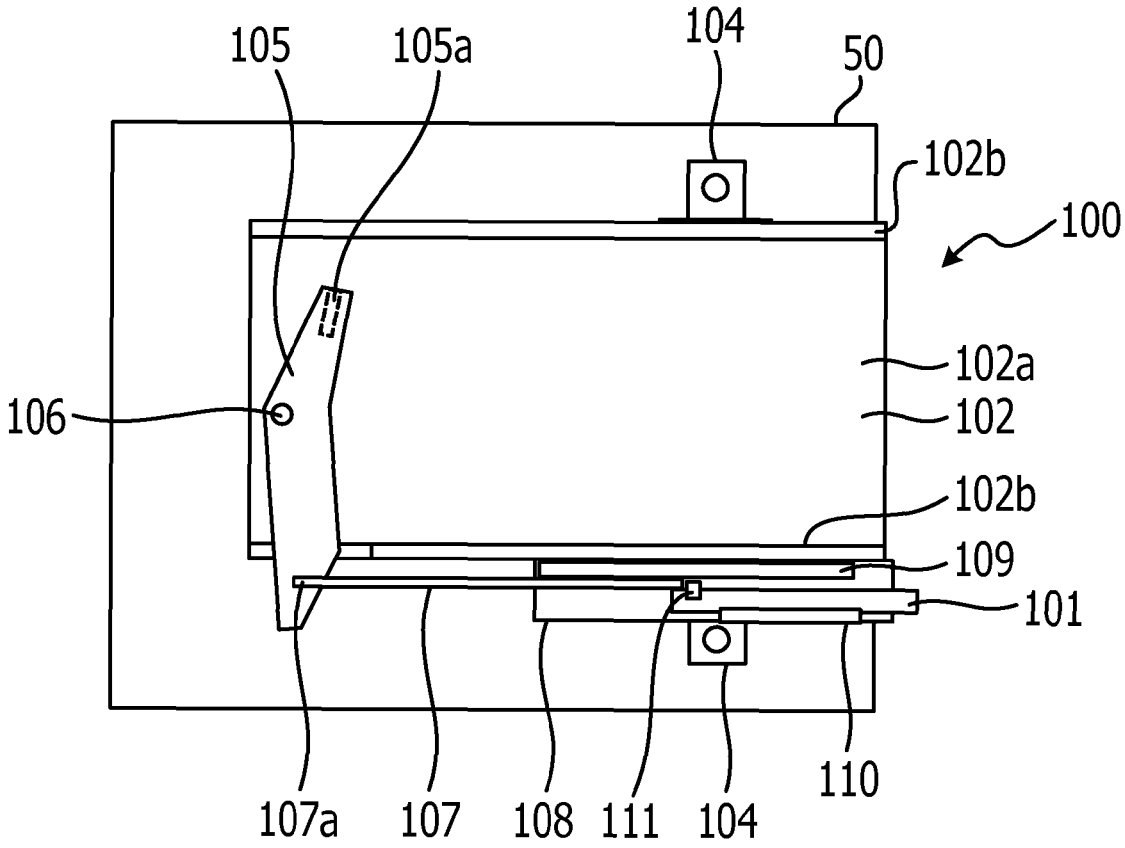
FIG. 6 is an explanatory view of a card connector in a state where the card-eject button is housed in the enclosure.

FIG. 1 is a perspective view of a PC 1000 that includes a substrate 50 where a card connector 100 is mounted in a card connector assembly according to an embodiment as illustrated in FIG. 6. The PC 1000 is a so-called laptop computer, and includes a display section 1001, and an enclosure body 1002 provided with a keyboard. The substrate 50 is housed in the enclosure body 1002. The enclosure body 1002 includes a top plate 1003. The top plate 1003 is removable. FIG. 2 illustrates a slot 1002*a* that is included in the enclosure body 1002 and used for card insertion. An opening 1002*b* is placed adjacent the slot 1002*a* in the enclosure body 1002. A card-eject button (hereinafter, referred as to simply a "button") 101 is exposed from the opening 1002*b*. The button 101 is included in the card connector 100.

Figure 3:
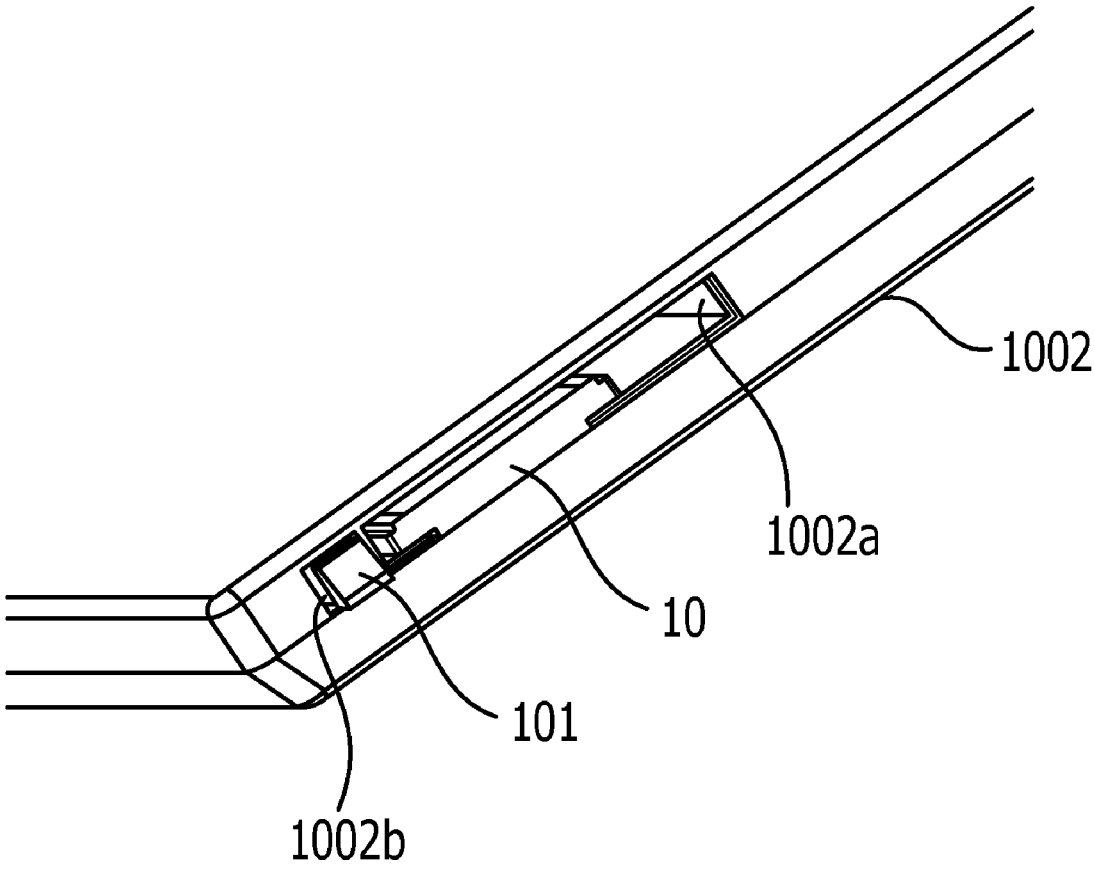
FIG. 3 is an explanatory view of a state where a card-eject button is housed in an enclosure and the card is inserted into the slot.

An Express card (hereinafter, referred to as simply a "card") 10 that is an example of a card is inserted into the slot 1002*a*. The card 10 is inserted and depressed into the slot 1002*a* and housed in the enclosure body 1002. The housed card 10 is ejected from the enclosure body 1002 by the operation of the button 101. FIG. 3 is an explanatory view of a state where the button 101 is housed in the enclosure body 1002 and the card 10 is inserted into the slot 1002*a*. When the PC 1000 is operated in a state where the card 10 has been inserted into the slot 1002*a*, the button 101 is in a state of being housed in the enclosure body 1002 as illustrated in FIG. 3.

Figure 4:
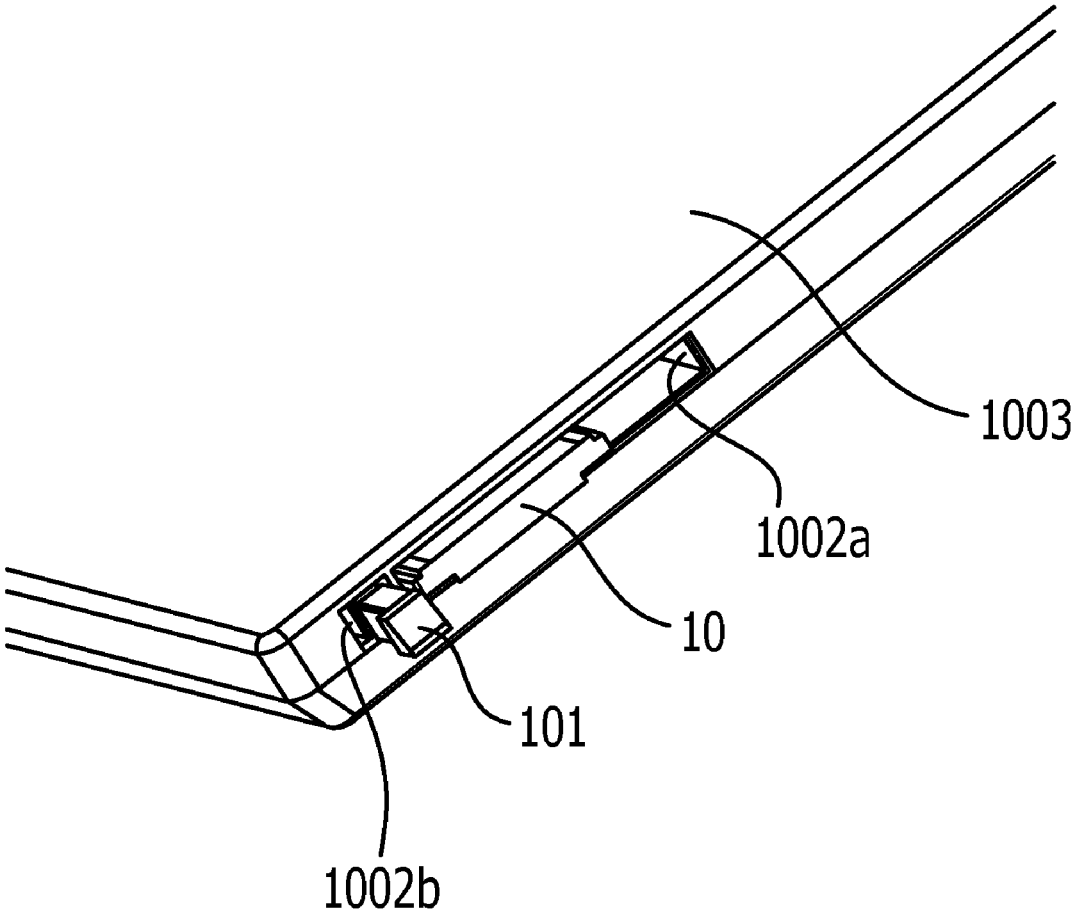
FIG. 4 is an explanatory view of a state where the card-eject button extends from the enclosure.
Figure 5:
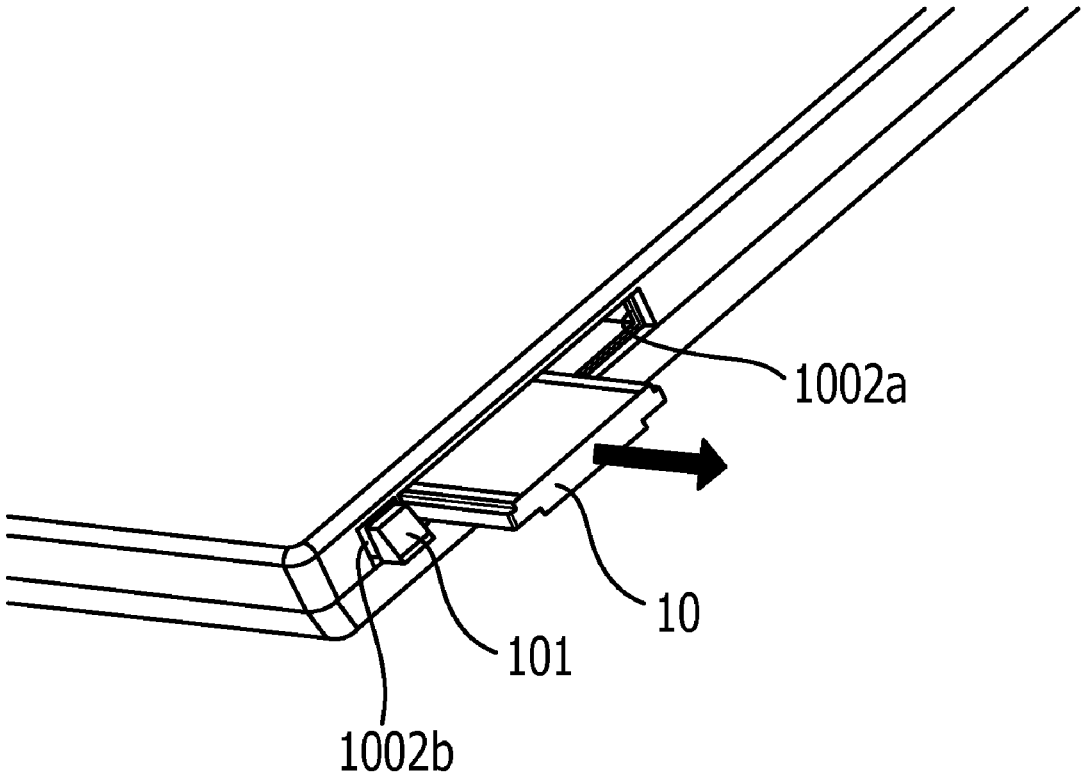
FIG. 5 is an explanatory view of a state where the card-eject button is depressed into the enclosure and the card is ejected from the enclosure.

The inserted card 10 is ejected from the slot 1002*a* by operating the button 101. The card 10 is ejected by performing an operation where the button 101 is pushed twice. FIG. 4 is an explanatory view of a state where the button 101 is pushed once after the state illustrated in FIG. 3 and extends from the enclosure body 1002. When the extended button 101 is depressed into the enclosure body 1002 again, the card 10 is ejected from the enclosure body 1002 as illustrated in FIG. 5.

When the operation of the button 101 is desired for the ejection of the card 10 from the enclosure body 1002 as described above, it is desirable that a preferable clearance between the button 101 and the opening 1002*b* is kept.

The card connector 100 provided with the above-described button 101 and a card-ejecting mechanism using the button 101 are described in detail below with reference to FIGS. 6 to 11. The card connector 100 is mounted on the substrate 50. The mounting of the card connector 100 on the substrate 50 is described in detail later.

Figure 14A:
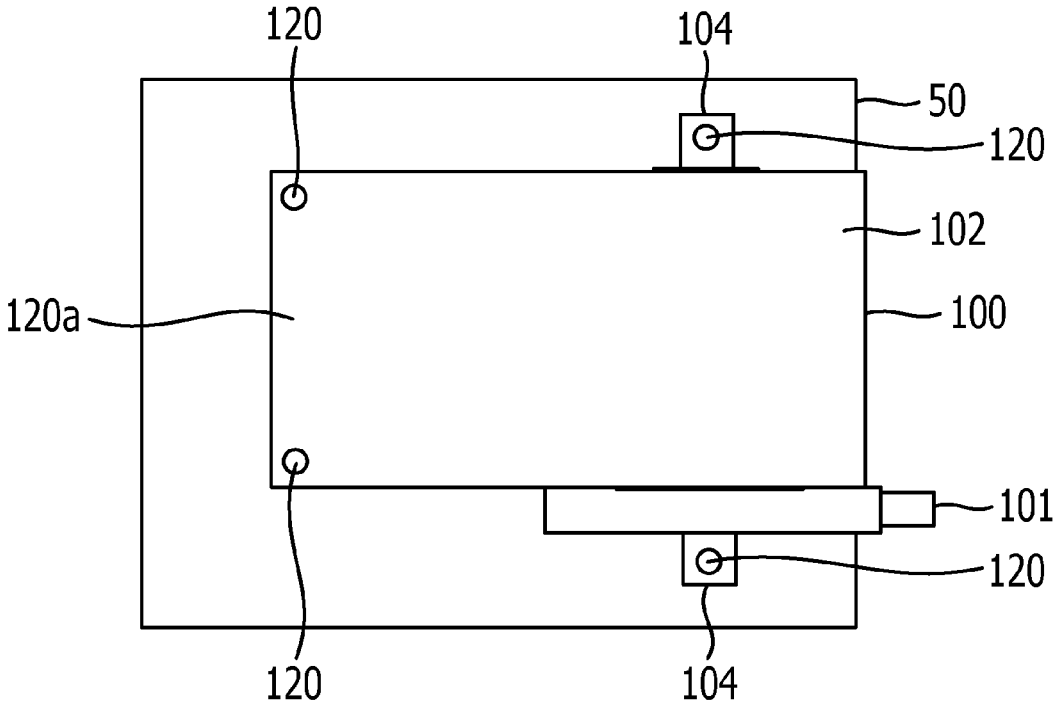
FIGS. 14A and 14B are explanatory views of a state where the card connector is being mounted on the substrate in a card connector assembly according to an embodiment.
Figure 14B:
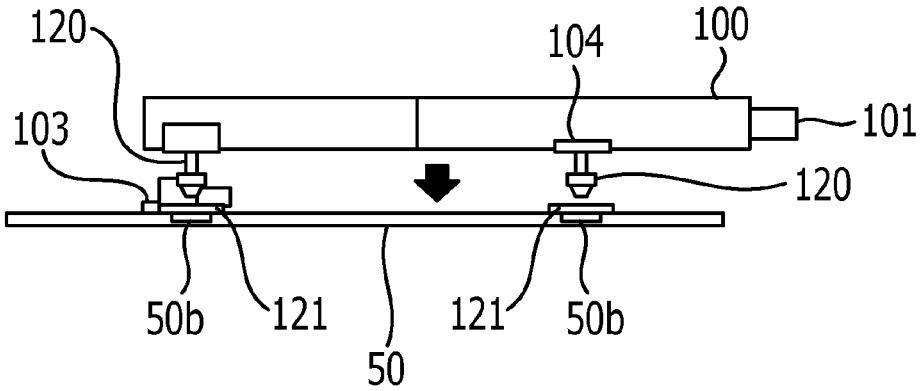
Figure 26:
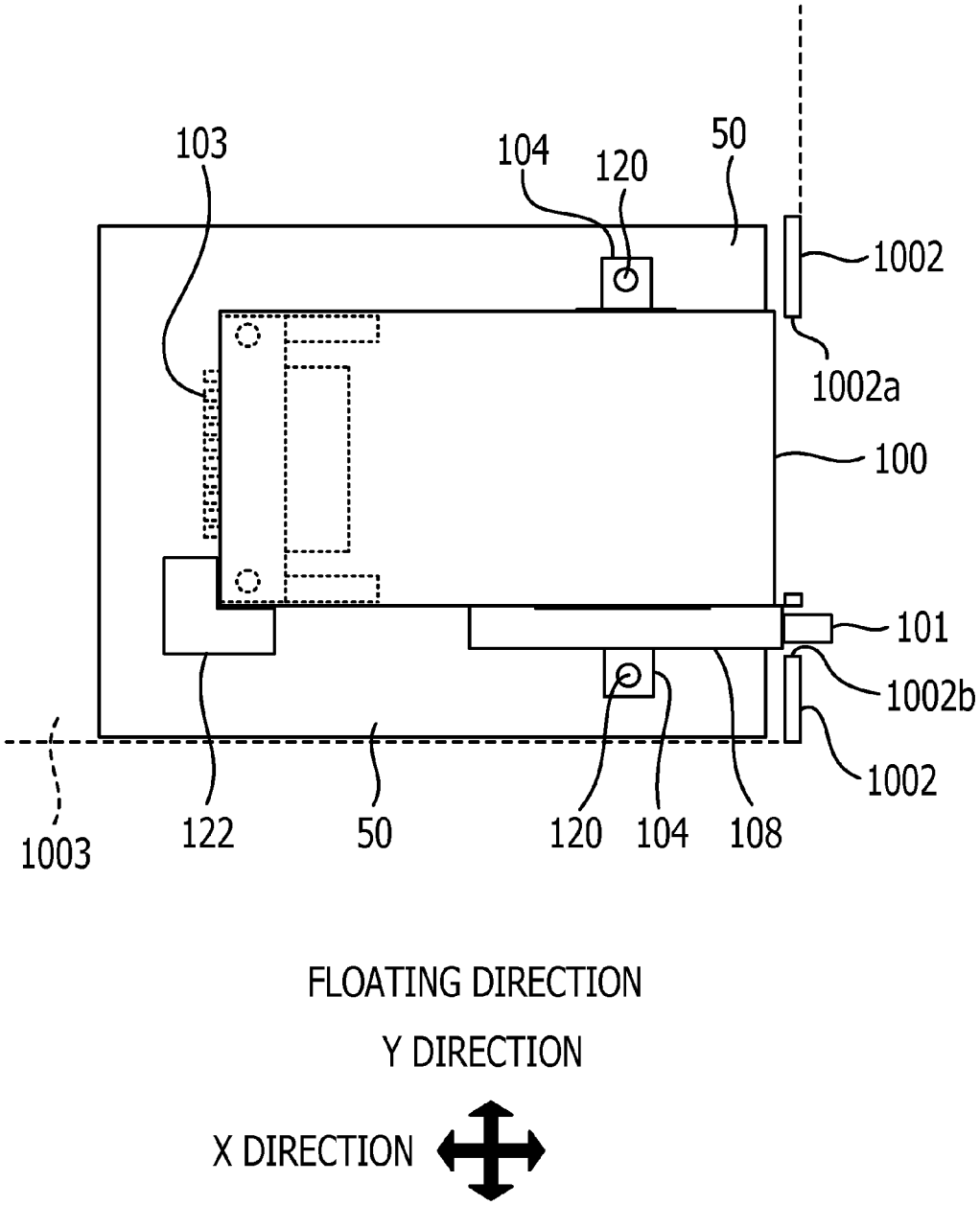
FIG. 26 is an explanatory view of a state where the movement of the card connector is regulated by a wall member.

The card connector 100 includes a guide section 102. The guide section 102 includes a plate member 102*a* that is flat and smooth, and guide members 102*b* that are rail-shaped and are provided on both sides of the plate member 102*a*. The card 10 is guided by the guide members 102*b* and slides on the plate member 102*a*. In addition, the card connector 100 includes a connector section 103 as illustrated in FIGS. 14B and 26 (not illustrated in FIGS. 6 to 8). The connector section 103 includes pin parts that are in contact with the card 10 and conduct electricity. The pin parts are solder-mounted on the substrate 50.

The card connector 100 includes flange sections 104 extended to both sides of the guide section 102 as illustrated in FIG. 6. The flange sections 104 are used for the mounting of the card connector 100 on the substrate 50.

The card connector 100 includes an arm member 105 at the rear end side of the guide section 102, that is, the side located on the inside of the enclosure body 1002 in the guide section 102. The arm member 105 includes a projection 105*a*. The arm member 105 pushes out the card 10 from the enclosure body 1002 by causing the projection 105*a* to abut the rear end section of the card 10.

Figure 7:
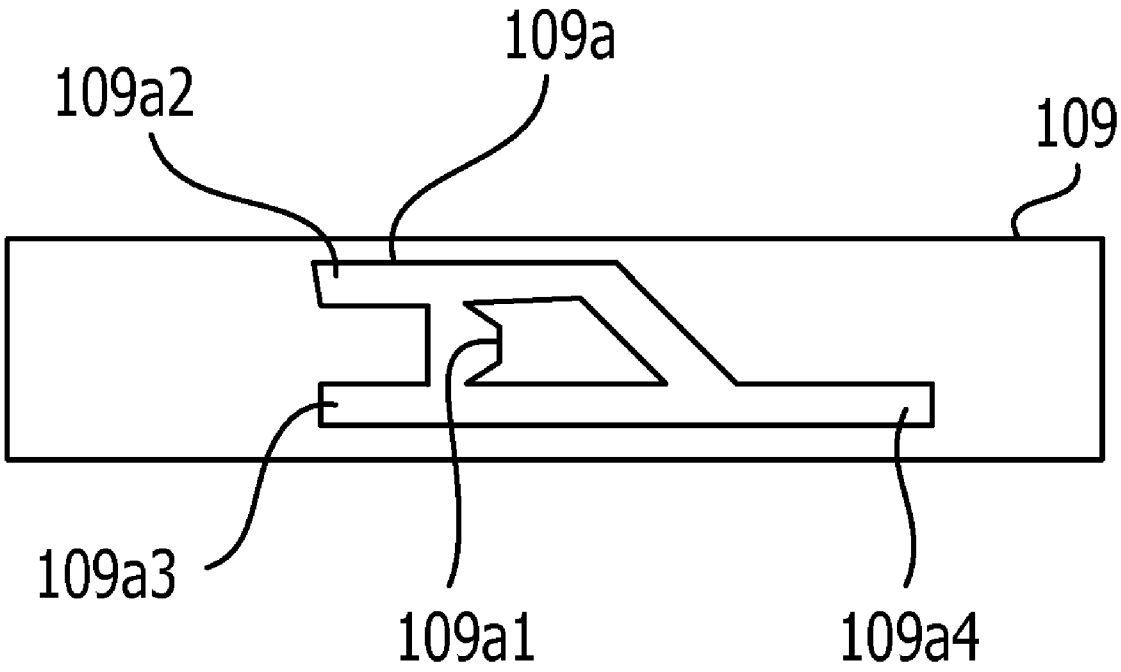
FIG. 7 is an explanatory view of a cam groove included in a base mold to guide the card-eject button.

The arm member 105 is pivotally mounted on the guide section 102 through a rotating shaft member 106. The projection 105*a* is provided on an end side of the arm member 105 and a pushrod 107 is provided on the opposite end side of the arm member 105. The card connector 100 includes a base mold 109 on the outside of the guide member 102*b* that is provided on the side where the pushrod 107 is placed. FIG. 7 is a side view of the base mold 109. As illustrated in FIG. 7, the base mold 109 is provided with a cam groove 109*a*. The cam groove 109*a* has a shape referred to as a so-called heart cam groove. The cam groove 109*a* includes a central passage 109*a*1 located substantially at the center of the base mold 109, a upper side passage 109*a*2 extending from the central passage 109*a*1 to the upper rear end side of the base mold 109, a lower side passage 109*a*3 extending from the central passage 109*a*1 to the lower rear end side of the base mold 109, and a front passage 109*a*4 extending linearly forward from the lower passage 109*a*3

Figure 8A:
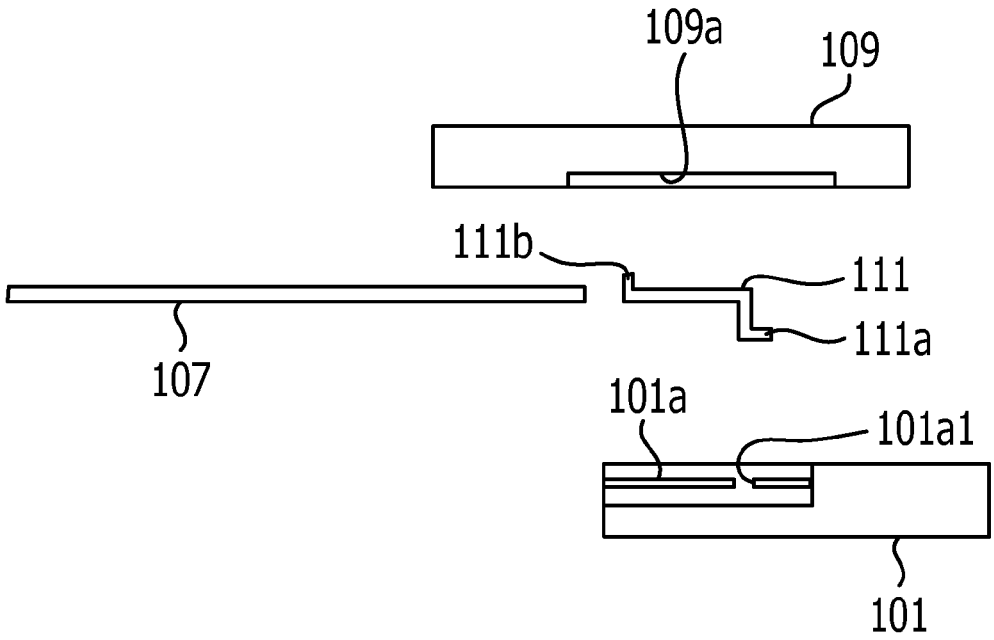
FIG. 8A is an explanatory view of a state where a part of a card-ejecting mechanism is taken apart.
Figure 8B:
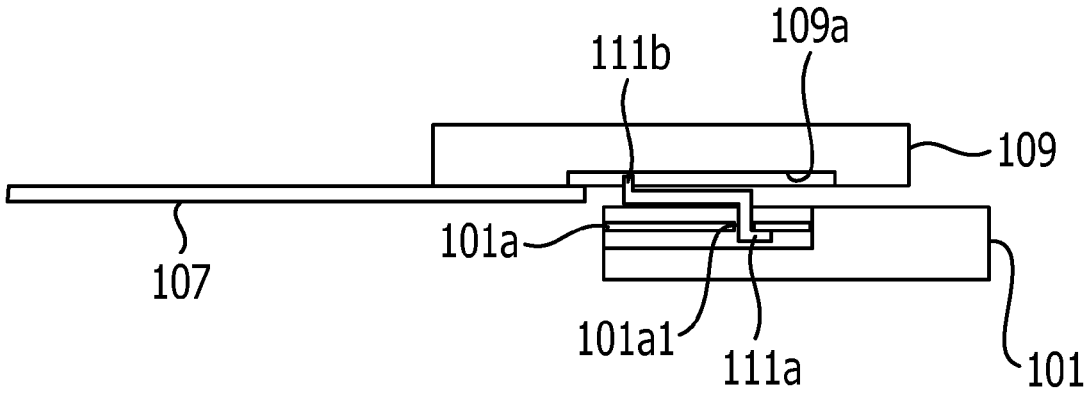
FIG. 8B is an explanatory view of a state where the part of the card-ejecting mechanism is assembled.

FIG. 8A is an explanatory view of a state where part of a card-ejecting mechanism is taken apart and FIG. 8B is an explanatory view of a state where the part of the card-ejecting mechanism is assembled. The button 101 includes an inner wall section 101*a*. The inner wall section 101*a* is provided with an engaging hole 101*a*1. A pin member 111 is mounted on the engaging hole 101*a*1. As illustrated in FIG. 8A, a first engagement section 111*a* extends from an end side of the pin member 111 and a second engagement section 111*b* extends from the opposite end side of the pin member 111. As illustrated in FIG. 8B, the first engagement section 111*a* engages the engaging hole 101*a*1 provided on the button 101, and the second engagement section 111*b* engages the cam groove 109*a* provided on the base mold 109. In addition, the second engagement section 111*b* includes a function to abut and depress the pushrod 107. The button 101 and the base mold 109 are housed in a cover member 108 provided on the guide member 102*b*.

A spring 110 is attached between the cover member 108 and the button 101. The spring 110 is attached so that the spring 110 is stretched while the button 101 is depressed into the enclosure body 1002.

Figure 9:
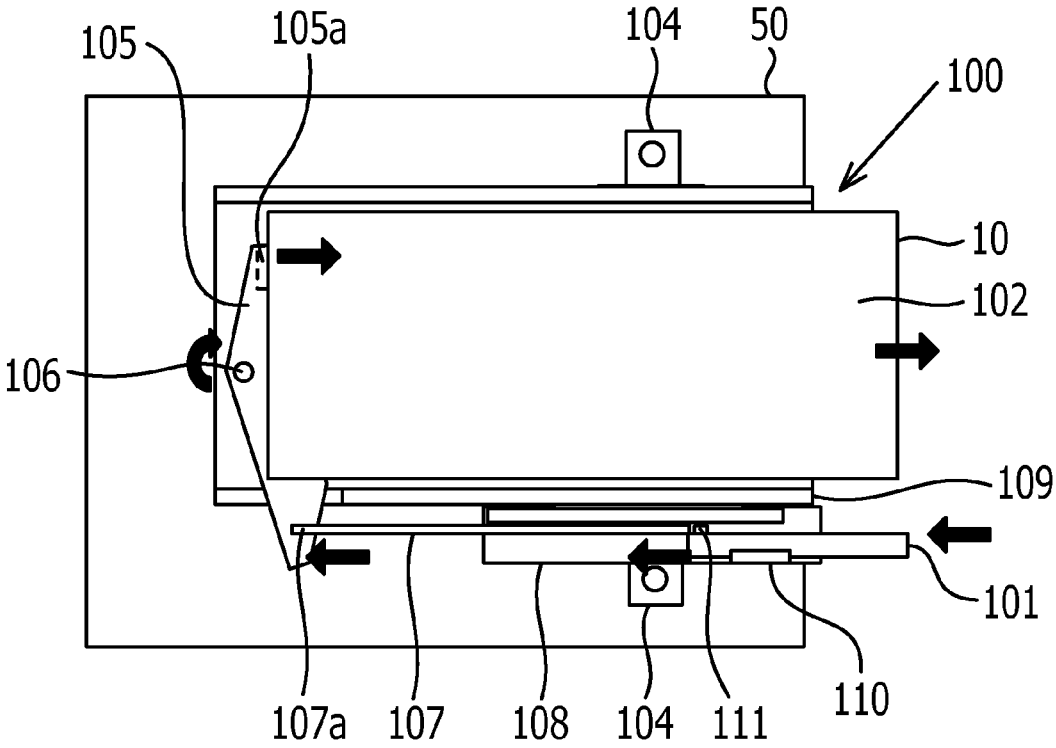
FIG. 9 is an explanatory view of the card connector in a state where the card is inserted into the enclosure and the card-eject button is exposed from the enclosure.
Figure 10:
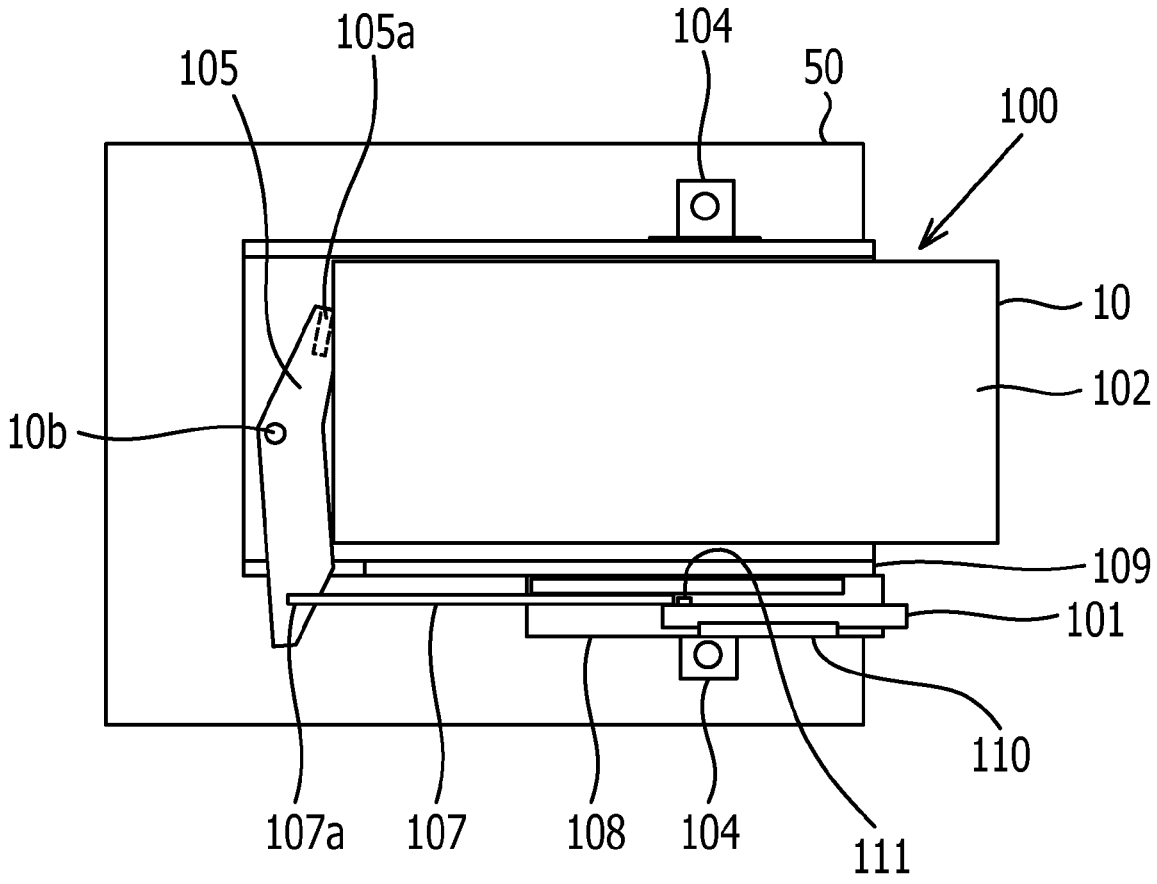
FIG. 10 is an explanatory view of the card connector in a case where the button is depressed into the enclosure and the card is ejected from the enclosure.

FIG. 9 is an explanatory view of the card connector 100 in a state where the card 10 is inserted into the enclosure body 1002 and the button 101 is exposed from the enclosure body 1002. FIG. 10 is an explanatory view of the card connector 100 in a case where the button 101 is depressed into the enclosure body 1002 and the card 10 is ejected from the enclosure body 1002. The movement of the button 101 is described with reference to FIGS. 11A to 11H in the above-described operations.

Figure 11A:
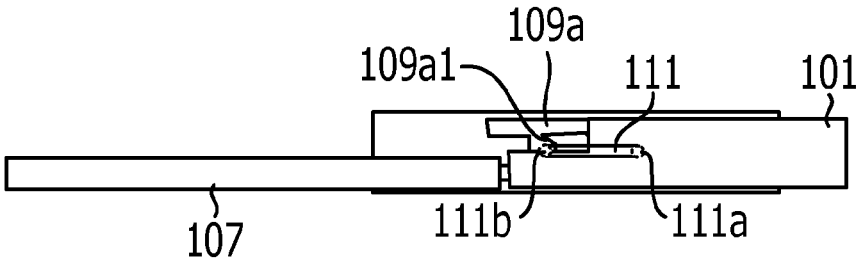
FIGS. 11A to 11H are explanatory views of sequential movements of the card-eject button.

FIG. 11A is an explanatory view of a state where the card 10 is not inserted into the slot 1002*a* included in the enclosure body 1002 and the button 101 is housed in the enclosure body 1002. In this state, the second engagement section 111*b* is located at the central passage 109*a*1. The spring 110 attached between the cover member 108 and the button 101 is in a stretched state (not illustrated in FIG. 11A).

Figure 11B:
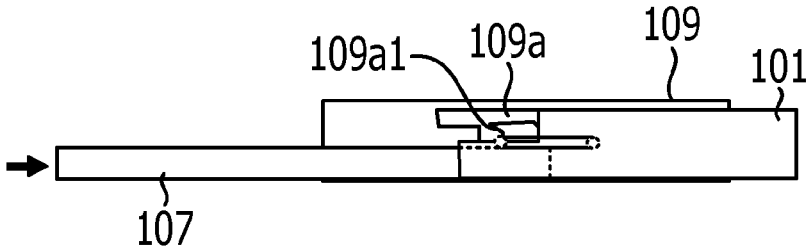

FIG. 11B is an explanatory view of a state where the card 10 has been inserted into the slot 1002*a*. The insert of the card 10 causes the rear end section of the card 10 to abut the projection 105*a*, so that the arm member 105 pivots. The pivoting of the arm member 105 causes the pushrod 107 attached to the arm member 105 to move in the direction illustrated by arrows in FIG. 11B.

Figure 11C:
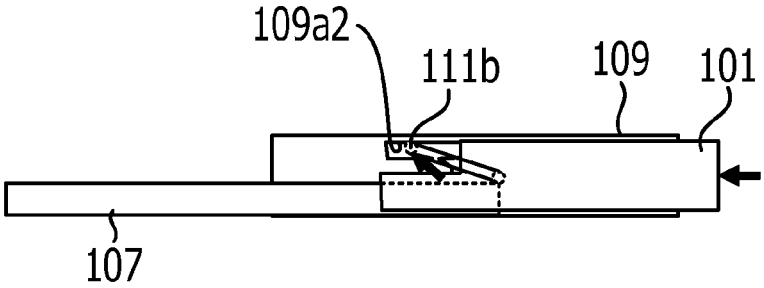

FIG. 11C is an explanatory view of a state where a first depression operation for the button 101 is performed to eject the card 10. When the button 101 is depressed into the enclosure body 1002, the second engagement section 111*b* located at the central passage 109*a*1 moves to the upper side passage 109*a*2. The spring 110 is further stretched at the same time.

Figure 11D:
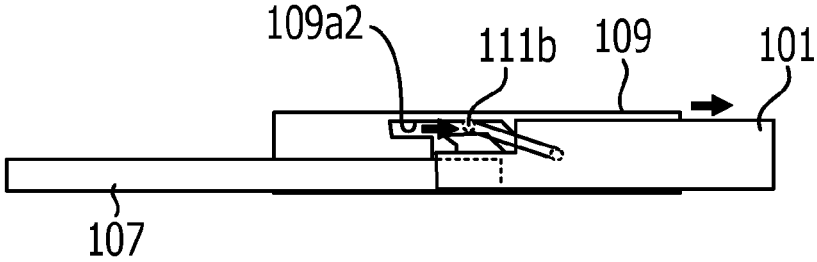

FIG. 11D is an explanatory view of a state where the button 101 is pulled forward (right side in FIG. 11D) by the tension of the spring 110. When the button 101 is pulled forward, the second engagement section 111*b* moved to the upper side passage 109*a*2 moves forward along the upper side passage 109*a*2.

Figure 11E:
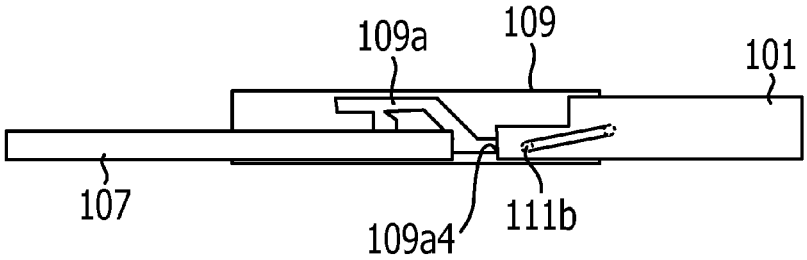

FIG. 11E is an explanatory view of a state where the second engagement section 111*b* has moved from the upper side passage 109*a*2 to the end of the front passage 109*a*4. When the second engagement section 111*b* moves to the end of the front passage 109*a*4, the button 101 becomes fully exposed from the enclosure body 1002, so that the first depression operation for the button 101 to eject the card 10 is completed. The state illustrated in FIG. 11E is associated with the state illustrated in FIG. 9.

Figure 11F:
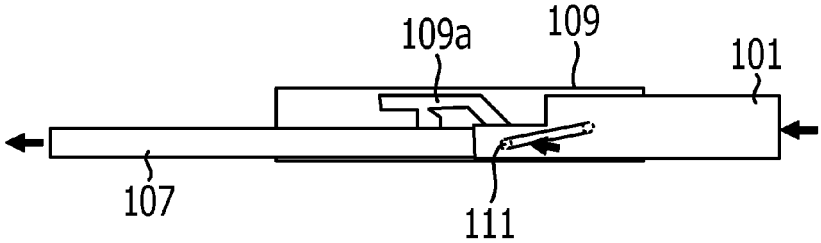

FIG. 11F is an explanatory view of a state where a second depression operation for the button 101 is performed to eject the card 10 after the state illustrated in FIG. 11E. The depression of the button 101 causes the second engagement section 111*b* to start to move from the front passage 109*a*4 to the rear end side of the lower side passage 109*a*3 (left side in FIG. 11F). As a result, the second engagement section 111*b* abuts and depresses the pushrod 107.

Figure 11G:
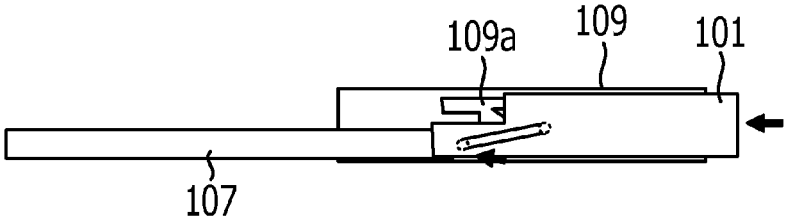

FIG. 11G is an explanatory view of a state where the second depression operation for the button 101 has been completed and the second engagement section 111*b* has moved to the rear end side of the lower side passage 109*a*3. When the pushrod 107 is depressed, power is transmitted as illustrated by arrows in FIG. 9. As a result, the arm 105 pivots, the projection 105*a* pushes out the rear end section of the card 10 as illustrated in FIG. 10, and the card 10 is ejected from the enclosure body 1002.

Figure 11H:
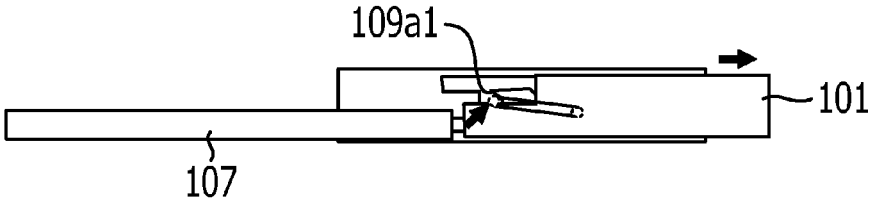

FIG. 11H is an explanatory view of a state where the depression operations for the button 101 has been completed and the button 101 has returned to the original position, that is, the button 101 has returned to the original position by the tension of the spring 110 after an operator of the button 101 has removed their finger from the button 101. Thus, the second engagement section 111*b* returns to the central passage 109*a*1. A projection is provided on the lower side passage 109*a*3 to prevent the second engagement section 111*b* from moving to the front passage 109*a*4. As a result, when the button 101 returns to the original position, the second engagement section 111*b* is prevented from moving to the front passage 109*a*4, moves to the side of the central passage 109*a*1, and returns to the original position.

As described above, when the card 10 is ejected from the enclosure body 1002, the button 101 is operated. The card-ejecting mechanism is a mere example; however, it is desirable that the preferable clearance between the button 101 and the opening 1002*b* is maintained.

The mounting of the card connector 100 on the substrate 50 to maintain the preferable clearance between the button 101 and the opening 1002*b* is described in detail below by comparing the embodiment with a comparative example. In the comparative example, a card connector 200 is mounted on the substrate 50. The common components between the card connector 200 according to the comparative example and the card connector 100 according to the embodiment are basically provided with identical reference numbers.

Figure 12A:
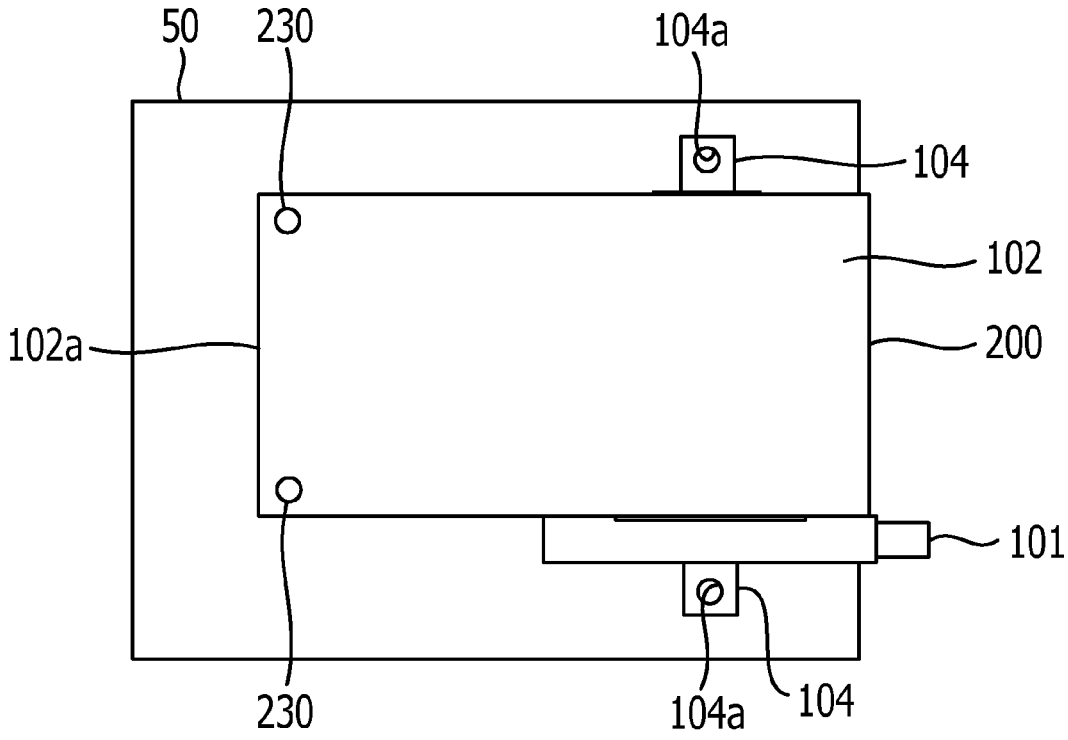
FIGS. 12A and 12B are explanatory views of a state where the card connector is being mounted on the substrate in a card connector assembly according to a comparative example.
Figure 12B:
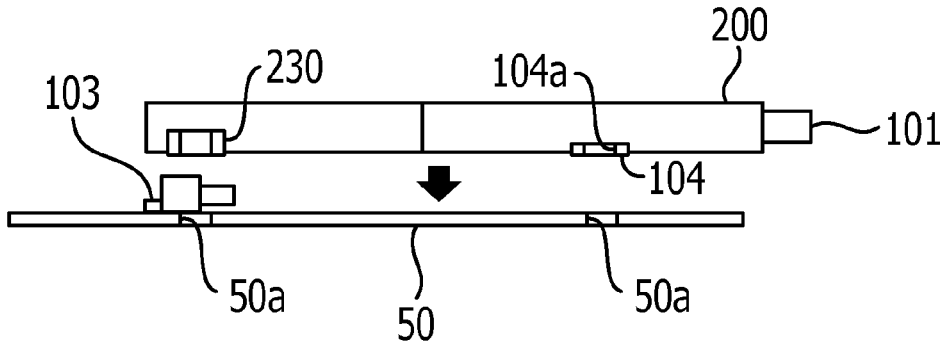
Figure 13A:
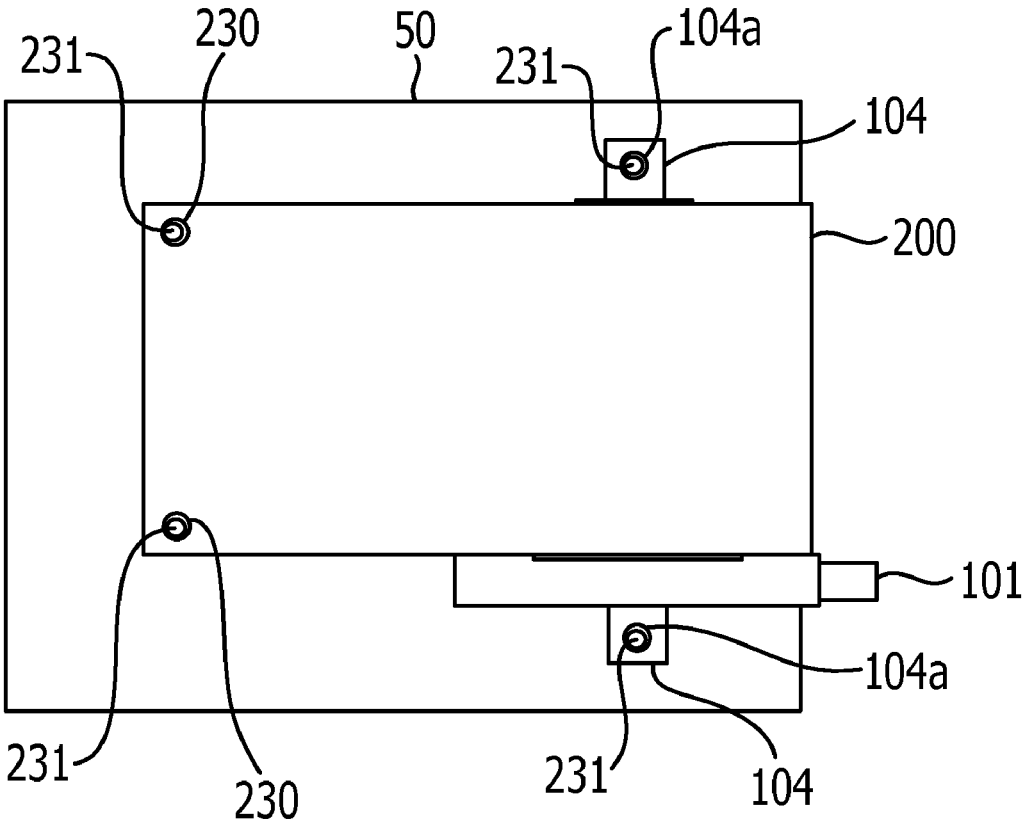
FIGS. 13A and 13B are explanatory views of a state where the card connector has been mounted on the substrate in the card connector assembly according to the comparative example.
Figure 13B:
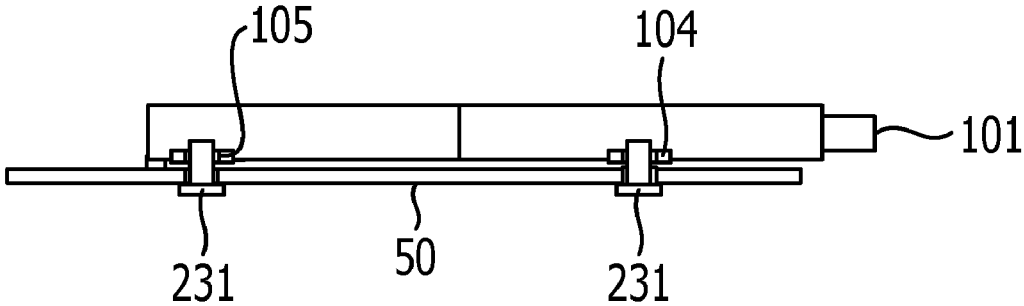

A card connector assembly according to the comparative example is described below with reference to FIGS. 12A to 13B. FIGS. 12A and 12B are explanatory views of a state where the card connector 200 is being mounted on the substrate 50 in the card connector assembly according to the comparative example, FIG. 12A is a top view of the state, and FIG. 12B is a side view of the state. FIGS. 13A and 13B are explanatory views of a state where the card connector 200 has been mounted on the substrate 50 in the card connector assembly according to the comparative example, FIG. 13A is a top view of the state, and FIG. 13B is a side view of the state. The card connector 200 includes built-in nut sections 230 on the plate member 102*a* of the guide section 102 as illustrated in FIG. 12A. The built-in nut sections 230 are provided on the left and right rear end sides of the plate member 102*a*. The feature where the flange sections 104 are provided on the guide section 102 is in common with the card connector 100. However, a screw hole 104*a* is provided on each of the flange sections 104 of the card connector 200. Through holes 50*a* are provided on the substrate 50 as illustrated in FIG. 12B. Such card connector 200 is mounted on the substrate 50 with screws 231. That is, the built-in nut sections 230 and the screw holes 104*a* are screwed with the screws 231 from the bottom side of the substrate 50 through the through holes 50*a*. The screws 231 are tightened at four places in total. The imbalance in the screw-tightening operation causes the mounting position of the card connector 200 to be misaligned. In addition, the accumulation of unevenness in the dimensions of each part as a result of poor machining accuracy may cause the mounting position of the card connector 200 being misaligned.

Figure 15A:
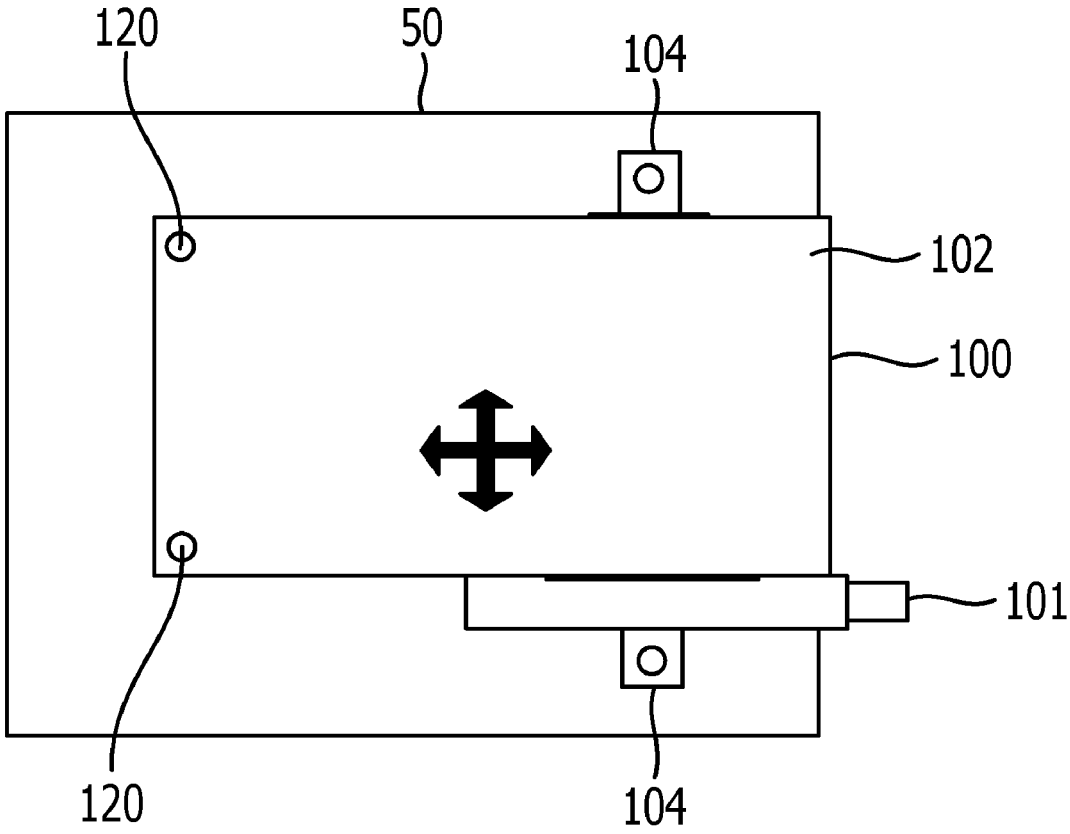
FIGS. 15A and 15B are explanatory views of a state where the card connector has been mounted on the substrate in the card connector assembly according to the embodiment.
Figure 15B:
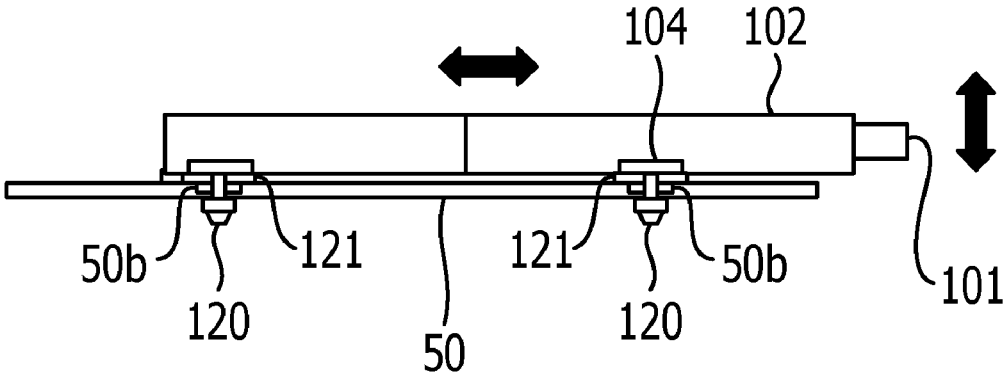

The card connector assembly according to the embodiment is described below with reference to FIGS. 14A to 19. FIGS. 14A and 14B are explanatory views of a state where the card connector 100 is being mounted on the substrate 50 in the card connector assembly according to the embodiment; FIG. 14A is a top view of the state, and FIG. 14B is a side view of the state. FIGS. 15A and 15B are explanatory views of a state where the card connector 100 has been mounted on the substrate 50 in the card connector assembly according to the embodiment; FIG. 15A is a top view of the state, and FIG.

Figure 16A:
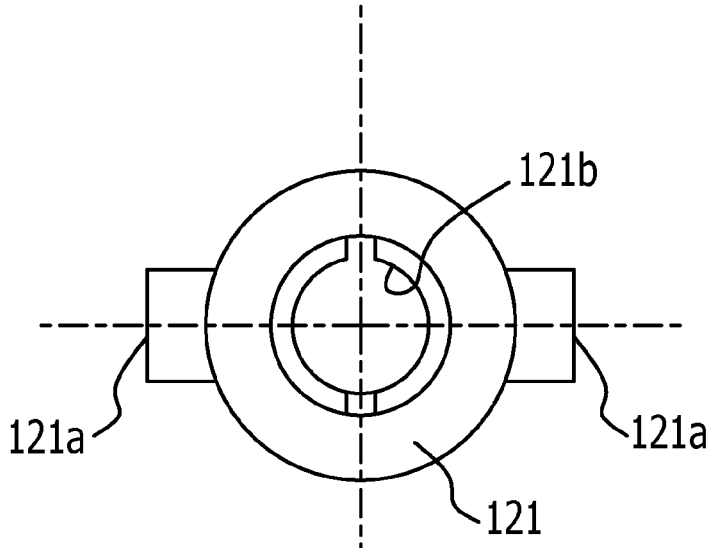
FIGS. 16A and 16B are explanatory views of a stud member according to the embodiment.
Figure 16B:
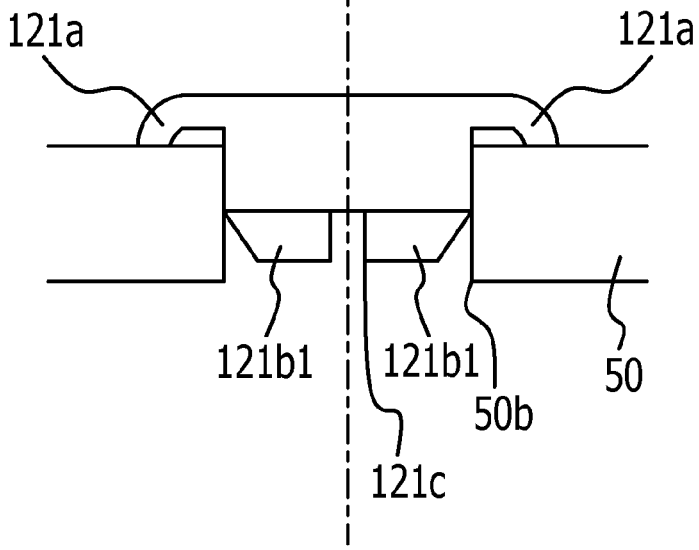
Figure 17:
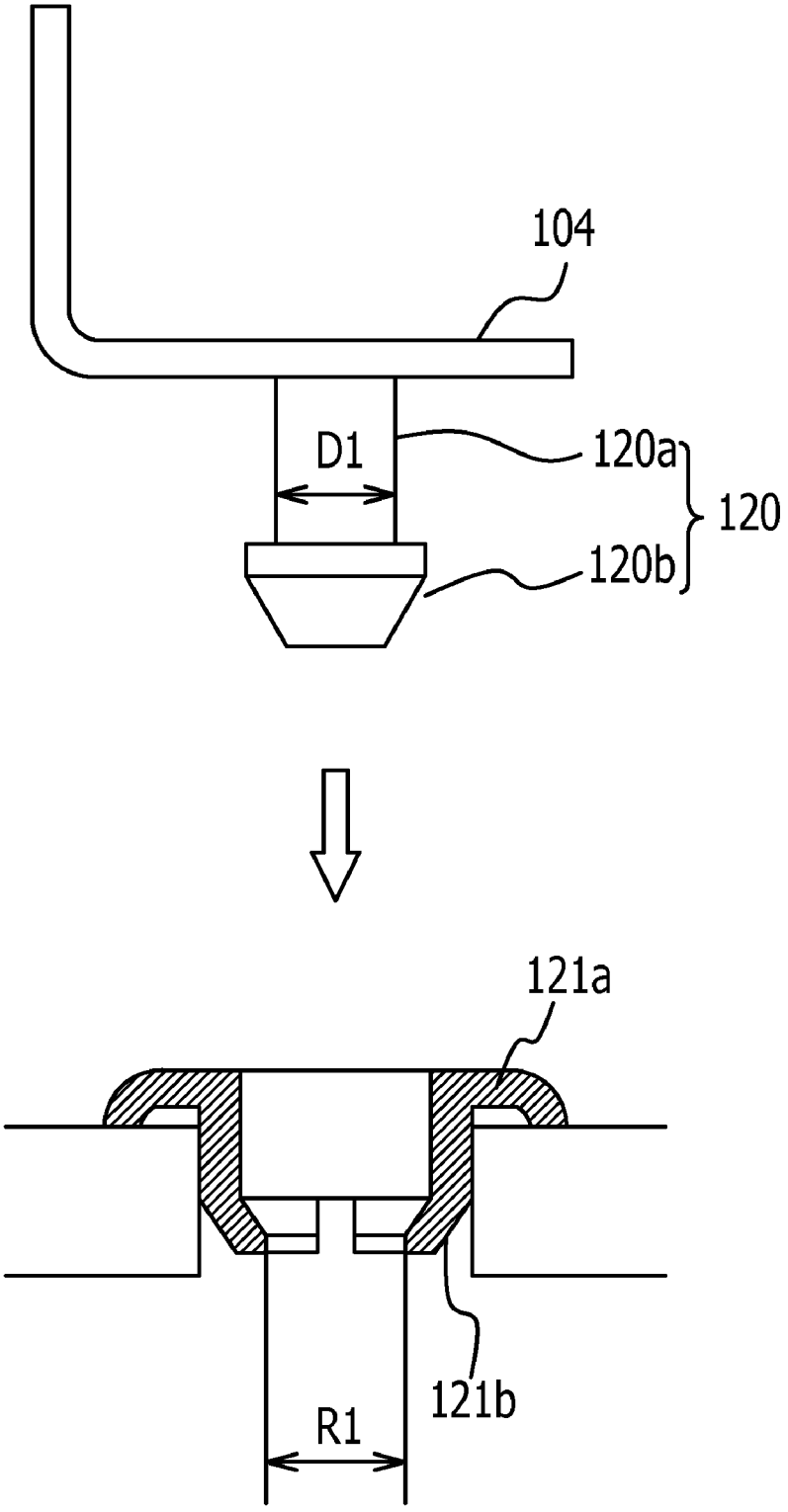
FIG. 17 is an explanatory view of a state where a pin member opposes the stud member.
Figure 18:
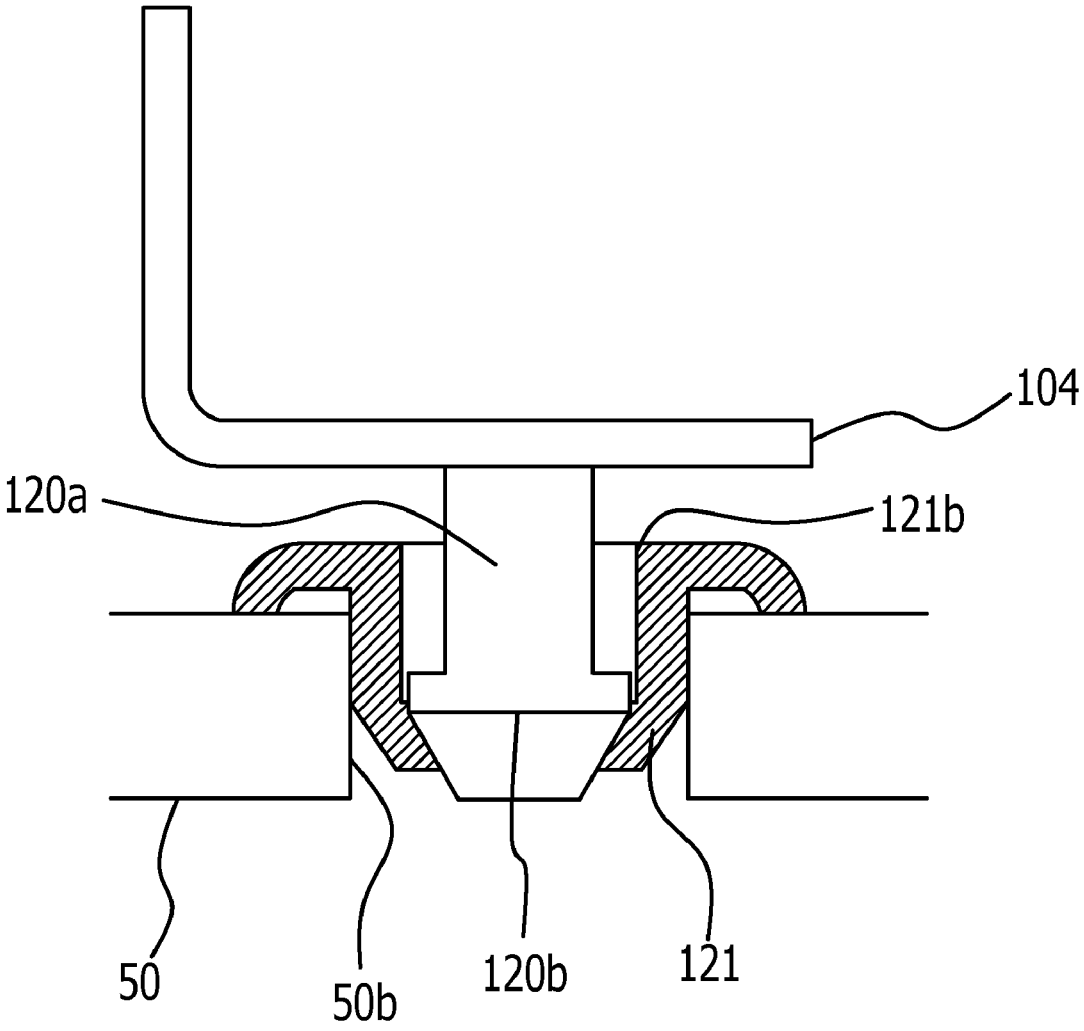
FIG. 18 is an explanatory view of a state where a tip of the pin member starts to be inserted into the stud member.
Figure 19:
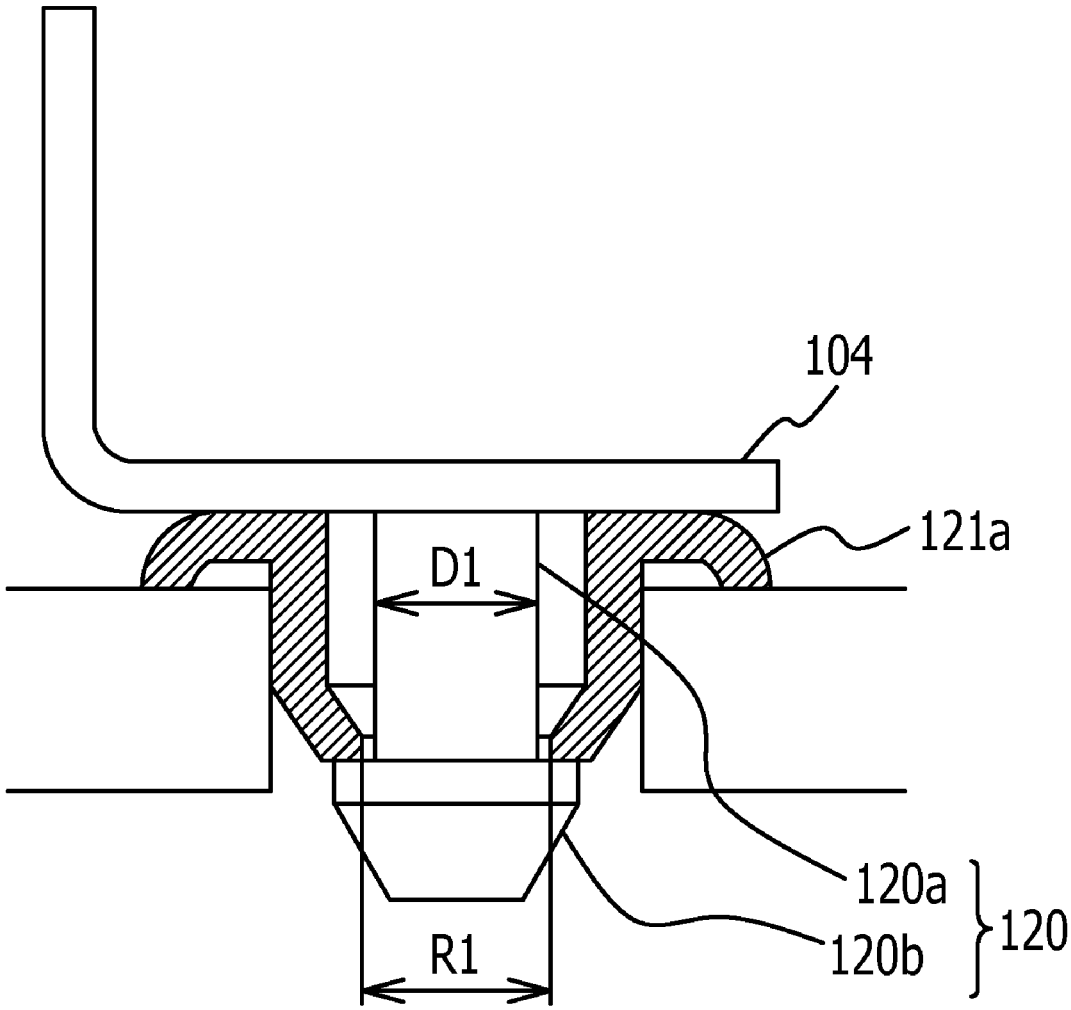
FIG. 19 is an explanatory view of a state where the insertion of the pin member into the stud member has been completed.

15B is a side view of the state. FIGS. 16A and 16B are explanatory views of a stud member 121 according to the embodiment; FIG. 16A is a top view of the stud member 121, and FIG. 16B is a side view of the stud member 121. FIG. 17 is an explanatory view of a state where a pin member 120 opposes the stud member 121. FIG. 18 is an explanatory view of a state where an engagement section (tip) 120*b* of the pin member 120 starts to be inserted into the stud member 121. FIG. 19 is an explanatory view of a state where the insertion of the pin member 120 into the stud member 121 has been completed.

The card connector 100 includes the pin members 120. The pin member 120 is provided on each of the left and right rear end sides of the plate member 102*a*, and on each of the flange sections 104 located at both sides of the plate member 102*a*, that is, the pin member 120 is provided on each of the four places in total. The pin member 120 may be provided on each of the lower surface sides of the plate member 102*a* instead of the flange sections 104, however, it is desirable that the pin member 120 is provided on each of the flange sections 104. The provision the pin member 120 on each of the flange sections 104 makes visual tasks easy when the pin member 120 is inserted into the stud member 121 (described later). The pin member 120 includes a neck 120*a* and an engagement section 120*b* coupled to the tip side of the neck 120*a* as illustrated in FIG. 17. The tip side of the engagement section 120*b* is formed in a tapered manner.

The substrate 50 includes through holes 50*b* instead of the through holes 50*a* according to the comparative example to attach the stud member 121. The through holes 50*b* are provided on the four places corresponding to the pin members 120.

As illustrated in FIG. 16, the stud member 121 includes a cylindrical insert member 121*b* where the pin member 120 is inserted, and an arm section 121*a* that is extended to the side of the cylindrical insert member 121*b*. The tip of the insert member 121*b* includes a reduced diameter section 121*b*1. The reduced diameter section 121*b*1 includes a notch 121*c*. The notch 121*c* causes the reduced diameter section 121*b*1 to have flexibility, allowing easier insertion of the engagement section 120*b* into the stud member 121.

As illustrated in FIG. 16B, in the stud member 121, the cylindrical insert member 121*b* is inserted into the through hole 50*b* of the substrate 50*b* and the arm section 121*a* abuts the upper surface of the substrate 50. The stud member 121 is mounted on the substrate 50 by soldering the arm section 121*a* to the substrate 50. As with other electronic parts, the stud member 121 is mounted on the substrate 50 and a reflow soldering may be performed in automated operations.

A dimensional relationship between the insert section 121*b* of the stud member 121 and the neck 121*a* of the pin member 120 is described below. As illustrated in FIG. 17, the outer diameter of the neck 120*a* is referred to as D1 and the inner diameter of the insert section 121*b*, for example, the inner diameter of the reduced diameter section 121*b*1, is referred to as R1. The outer diameter D1 of the neck 120*a* is smaller than the inner diameter R1 of the insert section 121*b* so that the pin member 120 is loosely fitted to the stud member 121 to have a floating structure. The outer diameter of the engagement section 120*b* is a little bigger than the inner diameter R1 of the insert section 121*b*.

When the pin member 120 having such dimensions is depressed into the insert section 121*b* of the stud member 121 as illustrated in FIG. 18, the pin member 120 may be easily inserted into the inset section 121*b* because the tip side of the engagement section 120*b* of the pin member 120 is formed in a tapered manner and the reduced diameter section 121*b*1 includes the notch 121*c*.

The pin member 120 inserted into the insert section 121*b* is in a state of being loosely fitted to the stud member 121 because the outer diameter D1 of the neck 120*a* is smaller than the inner diameter R1 of the insert section 121*b*. Thus, the card connector 100 is adjustably mounted on the substrate 50 in two orthogonal directions, for example, a direction for inserting/extracting the card 10 (hereinafter, referred to as X the direction) and a direction orthogonal to the direction for inserting/extracting the card 10 (hereinafter, referred to as the Y direction). As a result, the card connector 100 is in a so-called floating state, enabling subtle adjustment of the position of the card connector 100 relative to the substrate 50.

The pin member 120 is provided on the side of the substrate 50 by soldering etc. and the stud member 121 is provided on the side of the card connector 100, so that the card connecter 100 may be in a state where the position of the card connecter 100 is adjustable relative to the substrate 50. In this case, a dimensional relationship between the insert section 121*b* of the stud member 121 and the neck 121*a* of the pin member 120 is similar to the dimensional relationship according to the embodiment.

Any shape of the pin members may be employed as long as the pin member 120 is loosely fitted to the stud member 121 in a state where the pin member is inserted into the stud member 121.

Figure 20:
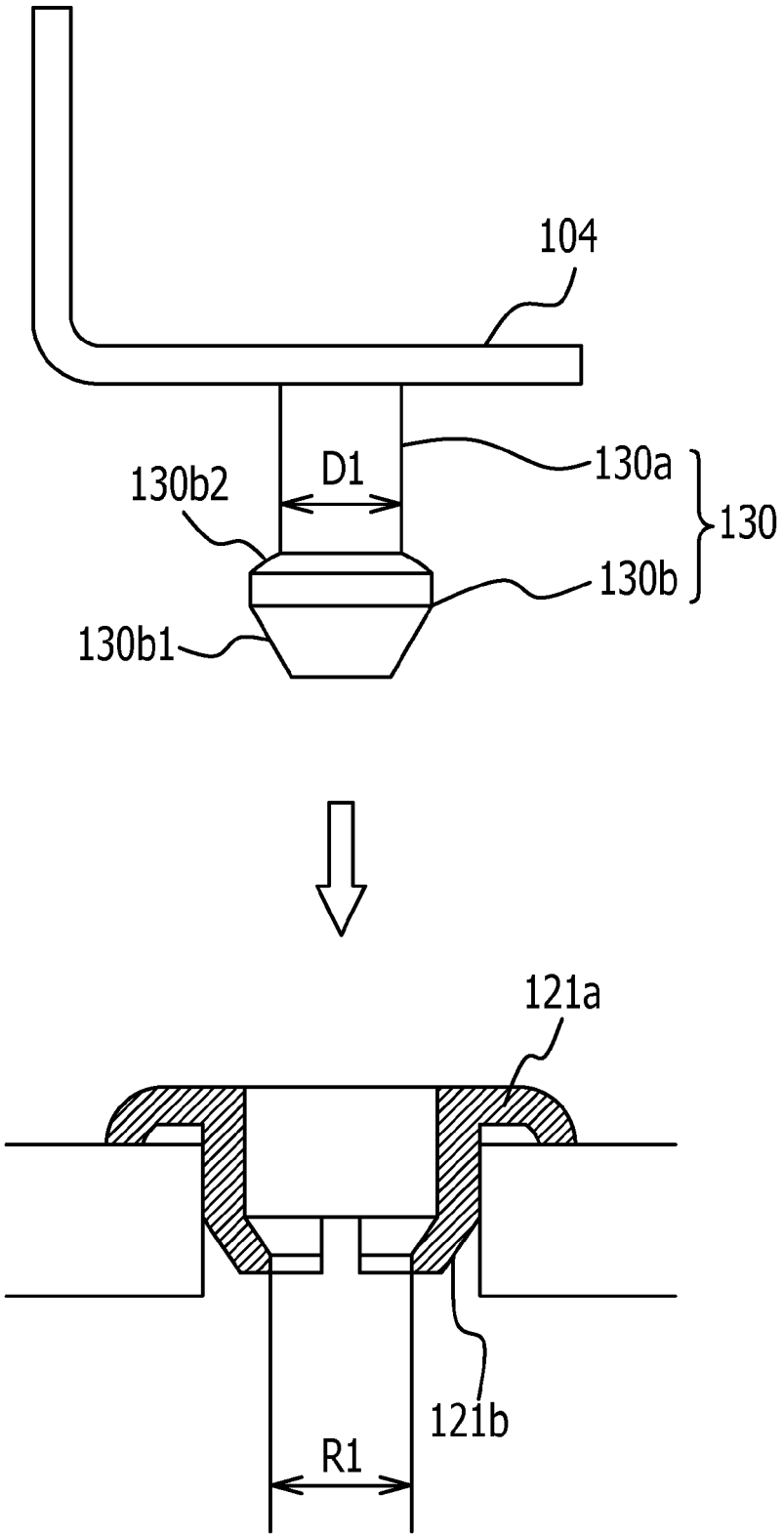
FIG. 20 is an explanatory view of a state where a pin member according to another embodiment opposes the stud member.
Figure 21:
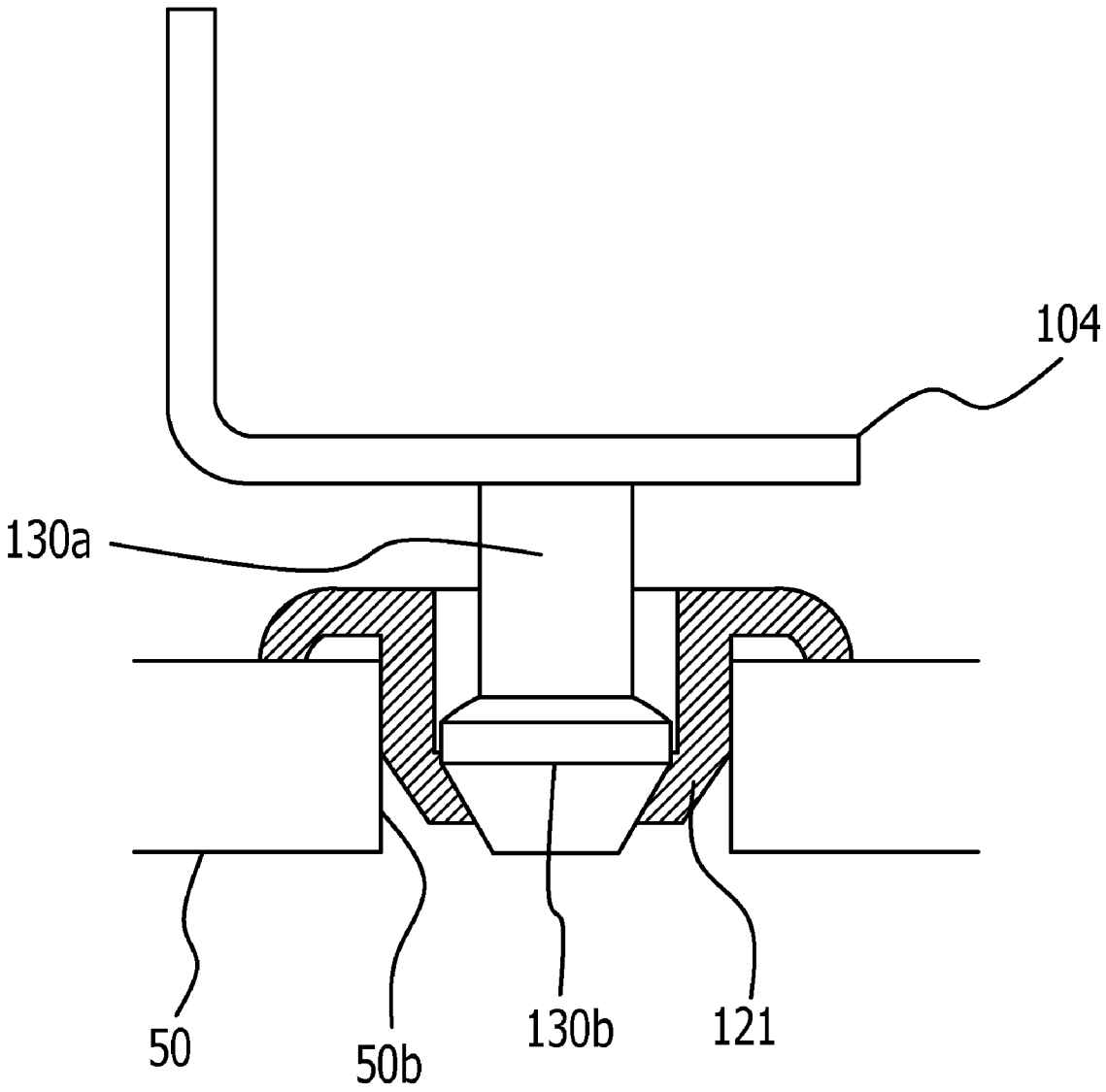
FIG. 21 is an explanatory view of a state where a tip of the pin member in FIG. 20 starts to be inserted into the stud member.
Figure 22:
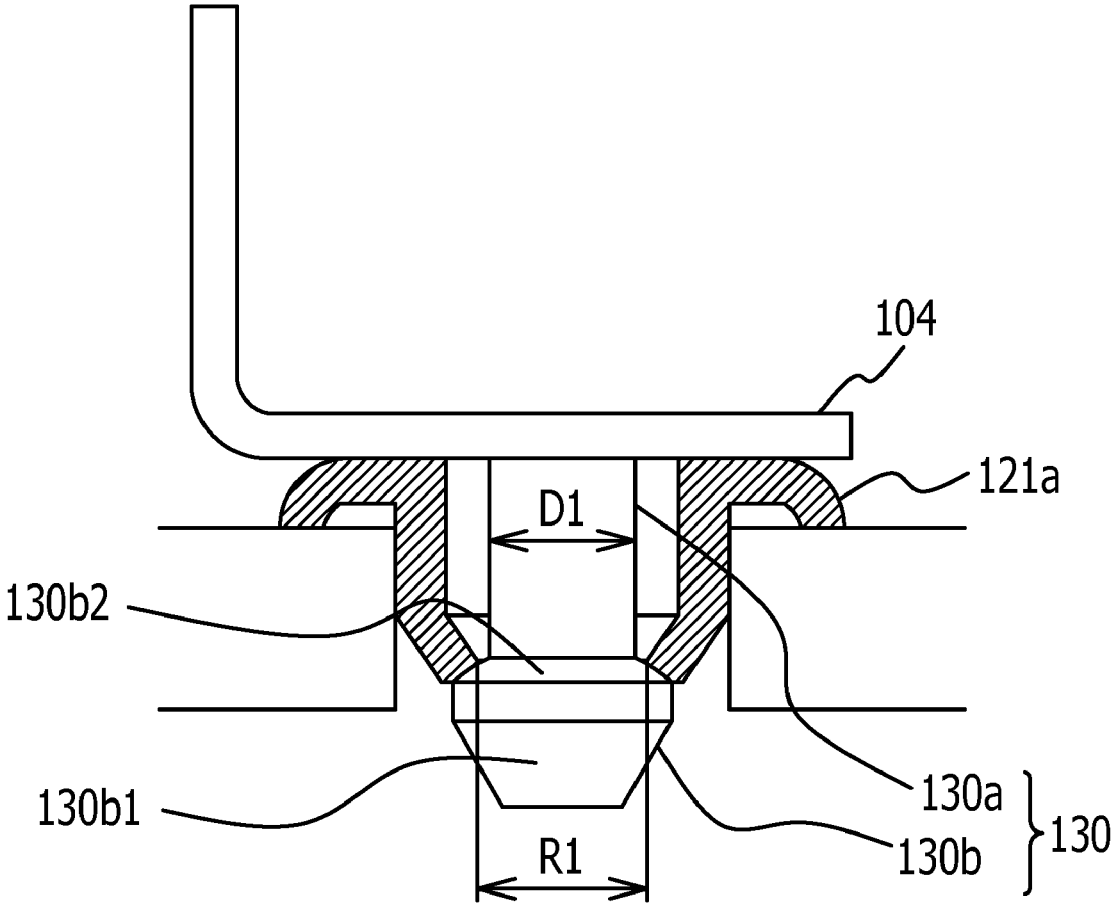
FIG. 22 is an explanatory view of a state where the insertion of the pin member in FIG. 20 into the stud member has been completed.

For example, a pin member 130 according to another embodiment illustrated in FIGS. 20 to 22 may be employed. FIG. 20 is an explanatory view of a state where the pin member 130 opposes the stud member 121. FIG. 21 is an explanatory view of a state where an engagement section (tip) 130*b* of the pin member 130 starts to be inserted into the stud member 121. FIG. 22 is an explanatory view of a state where the insertion of the pin member 130 into the stud member 121 has been completed. The tip side of the engagement section 120*a* of the pin member 120 illustrated in FIGS. 17 to 19 is formed in a tapered manner. The pin member 130 includes a neck 130*a* and the engagement section 130*b* coupled to the tip side of the neck 130*a*. The above-described configuration, where the pin member 130 includes the neck and the engagement section, is common to the configuration of the pin member 120. In addition, a dimensional relationship between the insert section 121*b* of the stud member 121 and the neck 131*a* of the pin member 130 is common to the dimensional relationship between the insert section 121*b* of the stud member 121 and the neck 121*a* of the pin member 120. That is, as illustrated in FIG. 21, the outer diameter of the neck 130*a* is referred to as D1 and the inner diameter of the insert section 121*b*, for example, the inner diameter of the reduced diameter section 121*b*1, is referred to as R1. The outer diameter D1 of the neck 130*a* is smaller than the inner diameter R1 of the insert section 121*b* so that the pin member 130 is loosely fitted to the stud member 121.

The pin member 130 provided with the engagement section 130*b* differs from the pin member 120 in that the engagement section 130*b* includes a first tapered section 130*b*1 located at the tip side of the pin member 130 and a second tapered section 130*b*2 located at the proximal side of the pin member 130. A diameter of the second tapered section 130*b*2 is successively decreased toward the proximal side of the pin member 130. The second tapered section 130*b*2 causes the card connector 100 to be easily removed from the substrate 50.

Figure 23:
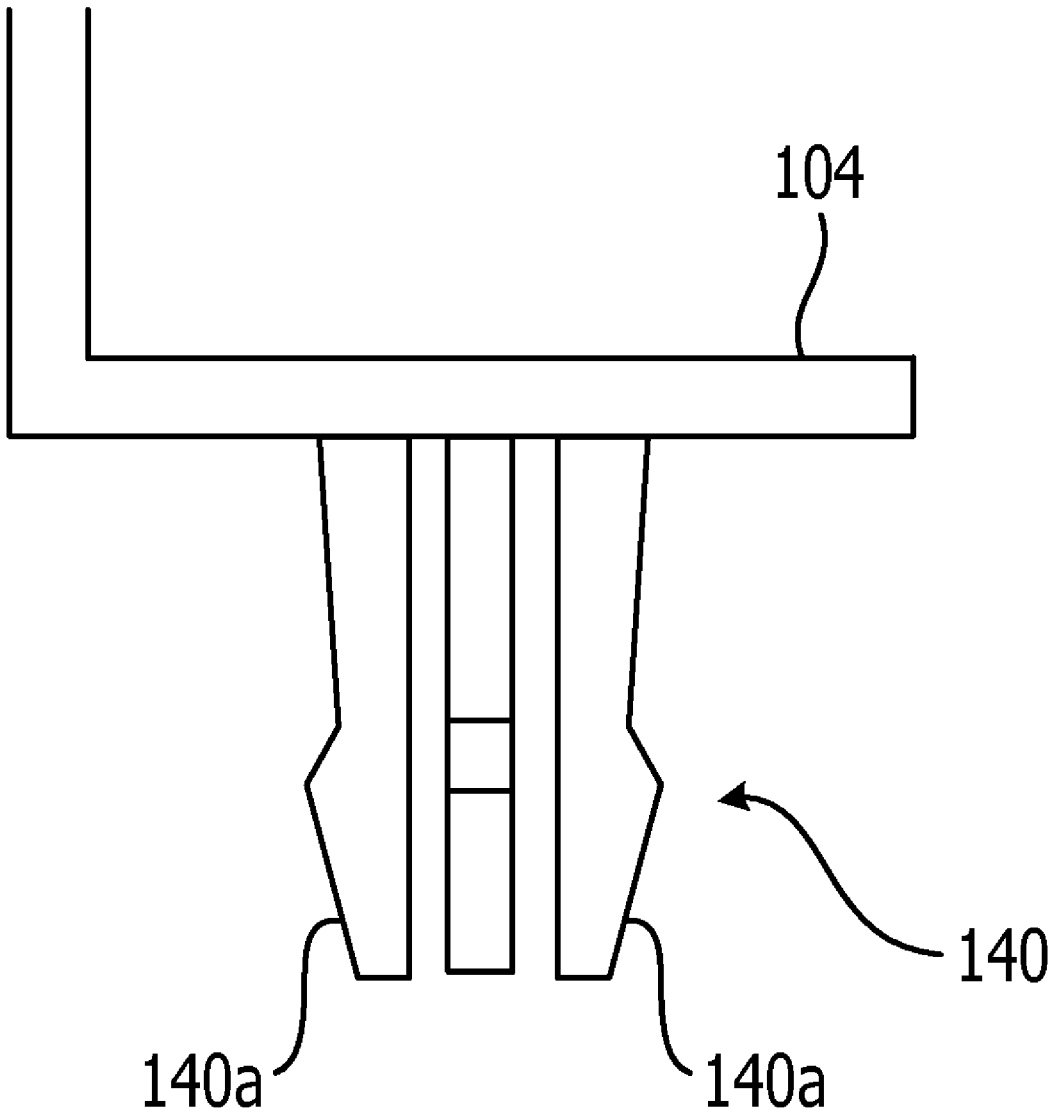
FIG. 23 is a side view of a pin member according to another embodiment.

In addition, a pin member 140 illustrated in FIG. 23 may be employed. The pin member 140 illustrated in FIG. 23 has a split pin shape divided into four parts. The tip of each of the four parts is provided with an engagement section 140*a* formed in a tapered manner. A neck is located on the proximal side from the engagement section 140*a*. The four parts are inserted into the insert section 121*b* of the stud member 121 as the four parts become narrow. The outer diameter of the neck located on the proximal side from the engagement section 140*a* of the pin member 140 is smaller than the inner diameter of the insert section 121*b* and the four parts may become narrow, so that the pin member 140 may be easily fitted to the stud member 121. Thus, the card connector 100 is mounted on the substrate 50 in a state where the position of the card connector 100 is adjustable in two orthogonal directions, for example, a direction for inserting/extracting the card 10 (X direction) and a direction orthogonal to the direction for inserting/extracting the card 10 (Y direction). As a result, the card connector 100 is in a so-called floating state, enabling subtle adjustment of the position of the card connector 100 relative to the substrate 50.

Figure 24:
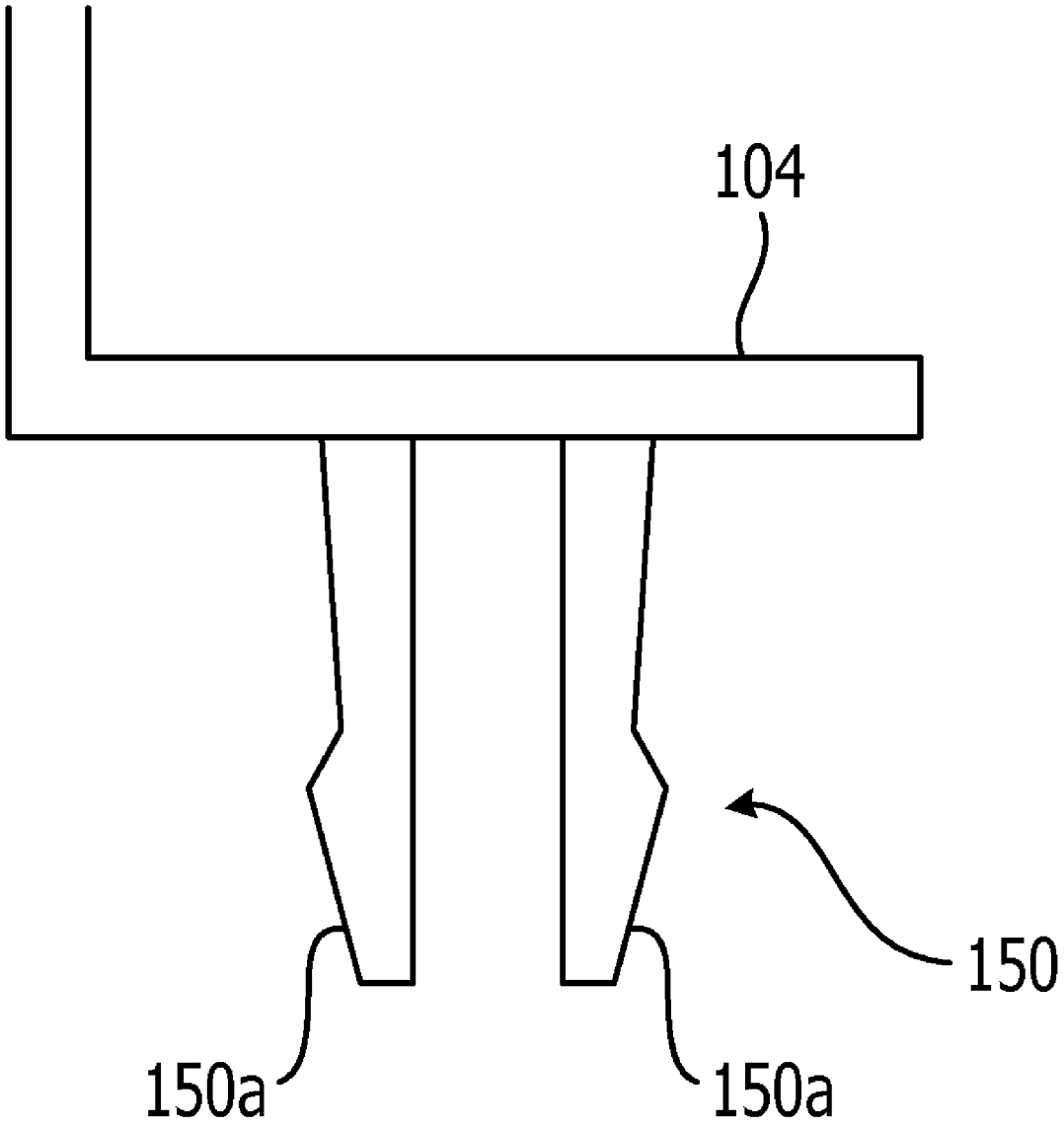
FIG. 24 is a side view of a pin member according to another embodiment.

In addition, a pin member 150 illustrated in FIG. 24 may be employed. The pin member 150 illustrated in FIG. 24 has a split pin shape divided into two parts. The tip of each of the two parts is provided with an engagement section 150*a* formed in a tapered manner. A neck is located on the proximal side from the engagement section 150*a*. The two parts are inserted into the insert section 121*b* of the stud member 121 as the two parts get narrow. The outer diameter of the neck located on the proximal side from the engagement section 150*a* of the pin member 150 is smaller than the inner diameter of the insert section 121*b* and the two parts may get narrow, so that the pin member 150 may be easily fitted to the stud member 121. Thus, the card connector 100 is mounted on the substrate 50 in a state where the position of the card connector 100 is adjustable in two orthogonal directions, for example, a direction for inserting/extracting the card 10 (X direction) and a direction orthogonal to the direction for inserting/extracting the card 10 (Y direction). As a result, the card connector 100 is in a so-called floating state, enabling subtle adjustment of the position of the card connector 100 relative to the substrate 50.

Figure 25A:
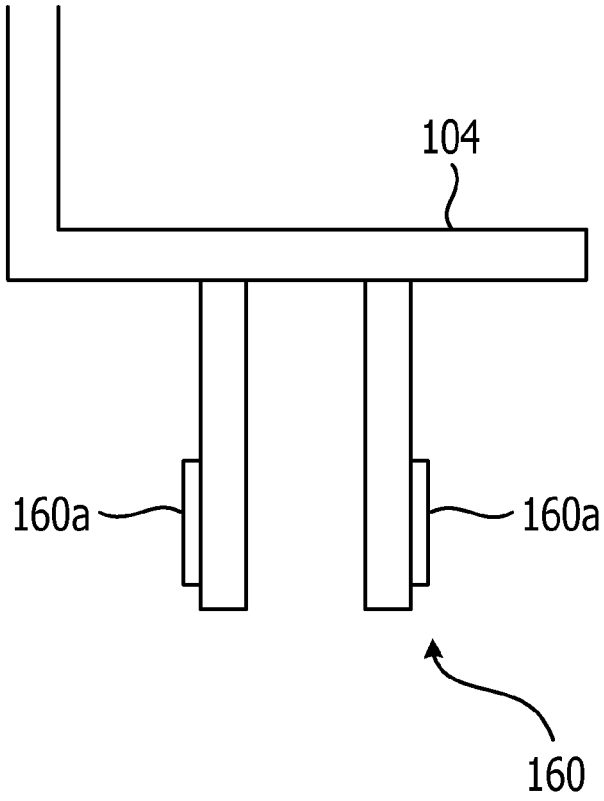
FIG. 25A is a front view of a pin member according to another embodiment and FIG. 25B is a side view of the pin member.
Figure 25B:
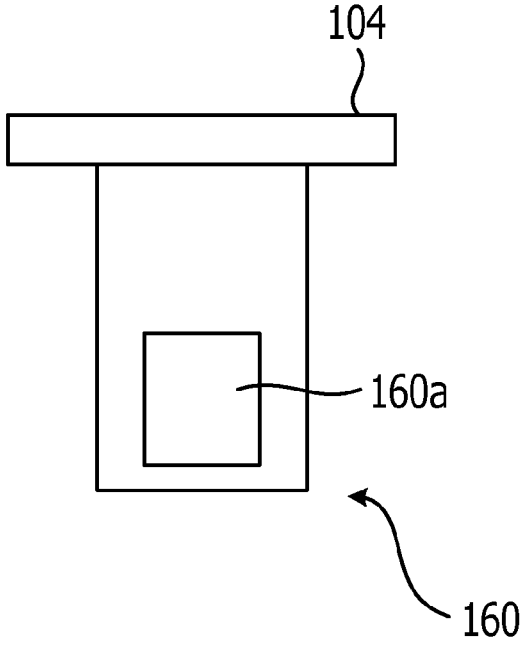

In addition, a pin member 160 illustrated in FIGS. 25A and 25B may be employed. FIG. 25A is a front view of the pin member 160 and FIG. 25B is a side view of the pin member 160. Two plates included in the pin member 160 are opposed to each other. An engagement section 160*a* is provided on the outside surface of each of the plates. A neck is located on the proximal side from the engagement section 160*a*. The engagement section illustrated in FIG. 25A has a substantially-rectangular shape. However, the engagement section may, for example, be in a protruding shape that gently rises. The two plates of the pin member 160 are inserted into the insert section 121*b* of the stud member 121 as the distance between two plates gets smaller. The distance between the plates, and the width and the thickness of the plates are set so that there is a clearance between the plates and the inner wall of the insert section 121*b* in a state of being inserted into the insert section 121*b*, and the pin member 160 is loosely fitted to the stud member 121. Thus, the card connector 100 is mounted on the substrate 50 in a state where the position of the card connector 100 is adjustable in two orthogonal directions, for example, a direction for inserting/extracting the card 10 (X direction) and a direction orthogonal to the direction for inserting/extracting the card 10 (Y direction). As a result, the card connector 100 is in a so-called floating state, enabling subtle adjustment of the position of the card connector 100 relative to the substrate 50.

After the above-described pin member 120, 140, 150, or 160 is inserted into the stud member 121 so that the pin member is loosely fitted to the stud member 121, the substrate 50 is mounted on the enclosure body 1002. The top plate 1003 is located on the enclosure body 1002. A wall member (e.g., protrusion) 122 that is L-shaped as illustrated in FIG. 26 is provided on the lower surface side of the top plate 1003, that is, the side opposed to the substrate 50. The wall member 122 abuts the card connector 100 in a state where the substrate 50 is housed in the enclosure body 1002, and regulates the movement of the card connector 100 in the orthogonal directions (X direction and Y direction).

The wall member 122 is L-shaped and includes a section extending in the X direction and a section extending in the Y direction. The wall member 122 provided on the top plate 1003 abuts a rear end corner section of the card connector 100 as illustrated in FIG. 26. Thus, the movement of the card connector 100 is regulated and the final positioning of the card connector 100 is performed. The card connector 100 is in a state of being pressed down gently with the top plate 1003, so that the positioning in a vertical direction (Z direction) of the card connector 100 may be performed, and rattling when the card connector 100 is mounted on the substrate 50 may be reduced if not prevented.

The top plate 1003 is included in the enclosure body 1002 and the positional relationship between the top plate 1003 and the opening 1002*b* can be easily set within a defined range. A preferable positional relationship that is between the button 101 and the opening 1002*b* and that is finally set by the wall member 122 may be kept when the wall member 122 is provided on the top plate 1003 that has the above-described relationship with the opening 1002*b*.

Thus, the interference of the movement of the button 101 may be reduced if not prevented. That is, when the substrate 50 is assembled, an operation to prevent the interference between the button 101 and the opening 1002*b* may be reduced if not eliminated. In addition, the occurrence of damage or distortion in the substrate 50 or the enclosure body 1002 that are possibly caused by an adjustment operation may be reduced if not prevented.

In addition, an operation to tighten the screw may be reduced if not eliminated because the card connector is mounted on the substrate 50 simply by depressing the pin member 120 into the stud member 121.

When the card connector 100 is mounted on the substrate 50 with two or more screws, an operation to adjust an amount of tightening the screw is generally desired. However, the card connector assembly according to the embodiment may perform the final positioning of the card connector 100 simply by depressing the pin member 120 into the stud member 121 and attaching the top plate 1003 including the wall member 122 to the enclosure body 1002. That is, the card connector 100 may be positioned so that interference between the card-eject button and the enclosure does not occur.

Although the embodiments of the present invention are numbered with, for example, "first," "second," or "third," the ordinal numbers do not imply priorities of the embodiment. Many other variations and modifications will be apparent to those skilled in the art.

Moreover, the term "or" is intended to mean an inclusive "or" rather than an exclusive "or". That is, unless specified otherwise, or clear from the context, the phrase "X employs A or B" is intended to mean any of the natural inclusive permu tations. That is, the phrase "X employs A or B" is satisfied by any of the following instances: X employs A; X employs B; or X employs both A and B. In addition, the articles "a" and "an" as used in this application and the appended claims should generally be construed to mean "one or more" unless specified otherwise or clear from the context to be directed to a singular form.

All examples and conditional language recited herein are intended for pedagogical purposes to aid the reader in understanding the invention and the concepts contributed by the inventors to further the art, and are to be construed as being without limitation to such specifically recited examples and conditions, nor does the organization of such examples in the specification relate to a showing of the superiority and inferiority of the invention. Although the embodiments of the invention have been described in detail, it will be understood by those of ordinary skill in the relevant art that various changes, substitutions, and alterations could be made hereto without departing from the spirit and scope of the invention as set forth in the claims.

What is claimed is:

1. An electronic apparatus comprising:

an enclosure having an opening through which a card is inserted;

a substrate installed within the enclosure;

a card connector mounted on the substrate, the card connector including a pin member having a neck section and an engagement section which is coupled to the tip side of the neck; and a stud member provided on the substrate, and having an elastic insert section through which the neck section of the pin member is inserted, wherein the neck section of the pin member is configured to have a floating structure with the stud member, said apparatus further comprising a wall member provided for the enclosure, the wall member configured to regulate movements of the card connector in the enclosure.

2. The card connector assembly according to claim 1, wherein the wall member configured to abut at least a corner portion of the card connector.

* * * * *